US007373097B2

(12) United States Patent
Ehara

(10) Patent No.: US 7,373,097 B2
(45) Date of Patent: May 13, 2008

(54) PRINTER ENGINE AND COLOR IMAGE FORMING DEVICE USING THIS PRINTER ENGINE FOR PREVENTING DEVIATION OF TRANSFER POSITIONS AND OVERLAP DEVIATION

(75) Inventor: Yasuhisa Ehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 11/206,086

(22) Filed: Aug. 18, 2005

(65) Prior Publication Data

US 2006/0039722 A1 Feb. 23, 2006

(30) Foreign Application Priority Data

Aug. 18, 2004 (JP) ..... 2004-238027
Mar. 18, 2005 (JP) ..... 2005-079025

(51) Int. Cl.
*G03G 15/00* (2006.01)
*G03G 15/01* (2006.01)

(52) U.S. Cl. ..... 399/167; 399/299; 399/301

(58) Field of Classification Search ..... 399/167, 399/298, 299, 301–303; 347/116
See application file for complete search history.

(56) References Cited

U.S. PATENT DOCUMENTS 6,278,857 B1 * 8/2001 Monji et al. ..... 399/301
6,408,157 B1 6/2002 Tanaka et al.
6,771,919 B2 * 8/2004 Koide ..... 399/167
6,889,022 B2 5/2005 Ehara et al.
6,898,400 B2 5/2005 Ehara
7,206,537 B2 * 4/2007 Funamoto et al. ..... 399/167
2004/0126137 A1 7/2004 Ehara
2004/0131386 A1 7/2004 Koide
2004/0161263 A1 8/2004 Ehara

FOREIGN PATENT DOCUMENTS

JP 10-20607 1/1998
JP 10-78734 3/1998
JP 2000-305337 11/2000
JP 2001-5363 1/2001

OTHER PUBLICATIONS

U.S. Appl. No. 09/408,433, filed Sep. 29, 1999, Ehara.
European Search Report.

* cited by examiner

*Primary Examiner*—William J. Royer
(74) *Attorney, Agent, or Firm*—Oblon, Spivak, McClelland, Maier & Neustadt, P.C.

(57) ABSTRACT

In cases where the transfer positions of toner images of respective colors that are formed on respective photosensitive bodies show a positional deviation, the rpm values of driving parts that drive the photosensitive bodies are adjusted in accordance with the amount of the positional deviation so that the linear velocities of the photosensitive bodies are constant. Alternatively, in the speed setting processing in which specified reference toner images are formed on the respective photosensitive bodies at a specified timing and are transferred onto an intermediate transfer belt, and then the relative amounts of mutual positional deviation of the respective reference toner images are calculated on the basis of the timing at which the respective reference toner images are detected by toner image detection sensors, and the driving speeds of the respective photosensitive bodies are individually set on the basis of the results of these calculations.

18 Claims, 21 Drawing Sheets

PRINTER ENGINE AND COLOR IMAGE FORMING DEVICE USING THIS PRINTER ENGINE FOR PREVENTING DEVIATION OF TRANSFER POSITIONS AND OVERLAP DEVIATION

BACKGROUND OF THE INVENTION

1. Field of the Invention

The present invention relates to a color image forming device such as a copier, facsimile device, printer or the like which utilizes an electrophotographic system in which toner images of different colors respectively formed on a plurality of image carriers are superimposed and transferred onto a transfer body or recording medium.

2. Description of the Related Art

Conventionally, devices equipped with a so-called printer engine constructed from a plurality of photosensitive bodies as image carriers, an endless intermediate transfer belt as a transfer body that successively passes through transfer positions mutually facing the respective photosensitive bodies, and a conveyor belt as a conveying member which holds and conveys a recording paper as a recording medium, have been known as color image forming devices of this type. In such color image forming devices, toner images of mutually different colors formed on the surfaces of the respective photosensitive bodies by the electrophotographic process are respectively overlapped and transferred onto the surface of the intermediate transfer belt, or onto the surface of the recording paper that successively passes through the respective transfer positions while being held on the conveyor belt, so that desired color images can be obtained.

In such a color image forming device, in cases where positional deviation occurs in the transfer positions of the respective color toner images when the respective color toner images formed on the respective photosensitive bodies are transferred onto the surface of the intermediate transfer belt or recording paper, the so-called "overlap deviation phenomenon" occurs in the color images obtained by the superimposition of the respective color toner images, so that the problem of a drop in image quality arises. The transfer position deviation that causes this overlap deviation phenomenon in such color images is caused by fluctuations in the light path due to temperature variations in the optical system that optically scans the respective photosensitive bodies, variations in the linear velocity of the respective photosensitive bodies and the like.

Conventionally, therefore, detection pattern toner images are formed on the respective photosensitive bodies, these detection pattern toner images are transferred onto the intermediate transfer belt or recording paper, and the spacing of these transferred detection pattern images is measured. Then, the exposure timing is varied so that this spacing is constant, and the positional deviation of the toner images in the respective transfer positions is thus corrected.

However, in the case of a method in which the transfer position deviation of the respective transferred color toner images is thus corrected by varying the timing of the exposure performed on the respective photosensitive bodies, the minimum amount of positional deviation that can be corrected corresponds to the dot diameter of the light beam that exposes the respective photosensitive bodies, e.g., 42 μm. Accordingly, in this conventional transfer position correction method, amounts of positional deviation at dimensions smaller than the dot diameter of the light beam cannot be corrected. Accordingly, the following problem arises:

namely, there are limits to the correction of the positional deviation of the respective color toner images that can be accomplished.

Furthermore, for example, in the image forming device disclosed in Japanese Patent Application Laid-Open No. 10-20607, in order to solve the problem of positional deviation of the respective color toner images, i.e., the problem of the overlap deviation phenomenon caused by this positional deviation, as described above, the occurrence of deviation in the superimposition of the respective color toner images is prevented by separately setting and processing the driving speeds of the respective photosensitive bodies. In the case of such setting and processing of the driving speeds of the respective photosensitive bodies, specified reference toner images are first formed on the respective photosensitive bodies at a specified timing, and these reference toner images are transferred to the surface of a belt member. Next, the relative amounts of positional deviation of the respective reference toner images with respect to each other are calculated on the basis of the timing at which these respective reference toner images are detected by a photo-sensor. Then, on the basis of the results of these calculations, the driving speeds of the respective photosensitive bodies are individually set, and the respective photosensitive bodies are driven at speed differentials corresponding to the respective amounts of positional deviation. As a result, deviation of the transfer positions of the toner images on the respective photosensitive bodies can be prevented, so that the respective color toner images can be effectively superimposed.

Meanwhile, the variation in the linear velocity of the photosensitive bodies that causes the overlap deviation phenomenon of the respective color toner images described above is caused by variation in the diameter dimensions of the respective photosensitive bodies, variation in the dimensions of the respective parts constituting the driving force transmission system that applies a rotational driving force to the respective photosensitive bodies, and the like. For example, variation in the linear velocity of the photosensitive bodies caused by eccentricity of the photosensitive body gears that are fastened to the rotating shafts of the photosensitive bodies is known.

Specifically, in such photosensitive body gears, when the location where the radius is the greatest due to eccentricity engages with the gear on the driving side, the linear velocity of the photosensitive body is slowest. On the other hand, when the location where the radius is smallest engages with the gear on the driving side, the linear velocity of the photosensitive body is highest. Since the former location and the latter location in the photosensitive body gear are located in point-symmetrical positions at 180 degrees from each other with reference to the center of rotation, fluctuating characteristics that trace a sine curve of one period appear in the linear velocity of the photosensitive body for each revolution of the gear. Furthermore, since the surface of each photosensitive body passes through the transfer positions at a maximum speed when the photosensitive body is rotating at a linear velocity corresponding to the upper limit of the sine curve, the toner image is transferred onto the recording paper in a shape that is extended further in the direction of movement of the surface of the photosensitive body than would inherently be the case. On the other hand, since the surface of the photosensitive body passes through the transfer positions at a minimum speed when the photosensitive body is rotating at a linear speed corresponding to the lower limit of the sine curve, the toner image in this case is transferred onto the recording paper in a shape that is more contracted in the direction of movement of the surface of the photosensitive body than would inherently be the case.

Thus, in the transfer process in which the respective color toner images are superimposed, when toner having a shape that is more contracted than the inherent shape is transferred onto a toner image with a shape that is extended further than the inherent shape on the intermediate transfer belt or recording paper, the abovementioned overlap deviation phenomenon occurs. Furthermore, this overlap deviation phenomenon also occurs when toner having a shape that is extended further than the inherent shape is transferred onto a toner image with a shape that is more contracted than the inherent shape.

In recent years, a type of control referred to as so-called "phase alignment", in which the rotational phases of a plurality of photosensitive body gears are synchronized, has been used in order to avoid such an overlap deviation phenomenon. Specifically, in this phase alignment control, marks are first applied to the locations of maximum diameter or locations of minimum diameter on the photosensitive body gears that are fastened to the rotating shafts of the respective photosensitive bodies, and these marks are detected by a photo-sensor or the like. Then, the rotational angles of the respective photosensitive body gears are respectively grasped on the basis of these detection results. If the respective photosensitive bodies are individually stopped at mutually identical rotational-angular positions on the basis of this understanding when the image formation operation is completed, then the rotational phases of the respective photosensitive body gears can be synchronized in the next image formation operation. Furthermore, the system may also be devised so that the rotational phases of the respective photosensitive body gears are aligned by temporarily causing the driving speeds of the driving sources of the respective photosensitive bodies to differ from each other on the basis of the amount of deviation in the rotational phase grasped by the detection results of the photo-sensor at the time that the image formation operation is initiated.

However, even if the rotational phases of the respective photosensitive body gears are aligned in this way, the painstakingly aligned rotational phases are skewed by the linear velocity difference in the respective photosensitive bodies in the case of a construction that imparts a linear velocity difference to the respective photosensitive bodies as in the image forming device disclosed in the abovementioned Japanese Patent Application Laid-Open No. 10-20607. Furthermore, as this linear velocity difference is increased, the skewing of the rotational phases of the photosensitive body gears becomes more severe, so that overlap deviation tends to be generated by phase deviation. Especially in the case of a continuous printing mode, i.e., a continuous image formation operation, in which images are continuously printed out on a plurality of recording papers, the phase deviation increases each time that an image is printed out, so that the problem of conspicuous overlap deviation arises.

Technologies relating to the present invention are (also) disclosed in, e.g., Japanese Patent Application Laid-Open No. 10-078734 and Japanese Patent Application Laid-Open No. 2001-005363.

SUMMARY OF THE INVENTION

It is an object of the present invention to provide a printer engine that makes it possible to obtain color images with a high image quality by preventing deviation in the transfer positions of the respective color toner images that occurs when respective color toner images formed on a plurality of image carriers are transferred onto an intermediate transfer body or recording medium, and preventing the overlap deviation phenomenon caused by this transfer position deviation, and a color image forming device using this printer engine.

A printer engine of the present invention comprises a plurality of photosensitive bodies which are rotationally driven, and which have toner images formed on the outer circumferential surfaces thereof; an endless belt which is disposed facing the outer circumferential surfaces of said photosensitive bodies, and which runs while carrying toner images that have been transferred from said photosensitive bodies, or while holding a recording medium onto which the toner images on said photosensitive bodies are transferred; means for forming detection pattern toner images on said photosensitive bodies which are used to detect the amount of positional deviation of the transfer positions of the toner images of the respective colors when the toner images formed on said photosensitive bodies are superimposed and transferred onto said endless belt or the recording medium held on said endless belt; means for transferring the detection pattern toner images formed on said respective photosensitive bodies onto said endless belt or transfer medium held on said endless belt; means for detecting the detection pattern toner images that have been transferred onto said endless belt or the recording medium held on said endless belt; means for judging the amount of positional deviation in the transfer positions of the detection pattern toner images of the respective colors on the basis of the detection results of said means for detecting the detection pattern toner images; and means for adjusting the rpm of driving parts that drive said photosensitive bodies on the basis of the judgment results of said means for judging the amount of positional deviation in the transfer positions so that the linear velocities of said photosensitive bodies are caused to agree with each other.

A color image forming device of the present invention comprises a printer engine; a recording medium accommodating part which accommodates a recording medium that is supplied to said printer engine; a fixing device which fixes color toner images that are transferred onto said recording medium; and a recording medium discharge part to which the recording medium on which a toner image has been fixed is discharged, said printer engine comprising a plurality of photosensitive bodies which are rotationally driven, and which have toner images formed on the outer circumferential surfaces thereof, an endless belt which is disposed facing the outer circumferential surfaces of said photosensitive bodies, and which runs while carrying toner images that have been transferred from said photosensitive bodies, or while holding a recording medium onto which the toner images on said photosensitive bodies are transferred, means for forming detection pattern toner images on said photosensitive bodies which are used to detect the amount of positional deviation of the transfer positions of the toner images of the respective colors when the toner images formed on said photosensitive bodies are superimposed and transferred onto said endless belt or the recording medium held on said endless belt, means for transferring the detection pattern toner images formed on said respective photosensitive bodies onto said endless belt or the transfer medium held on said endless belt, means for detecting the detection pattern toner images that have been transferred onto said endless belt or the recording medium held on said endless belt, means for judging the amount of positional deviation in the transfer positions of the detection pattern toner images of the respective colors on the basis of the detection results of said means for detecting the detection pattern toner images, and means for adjusting the rpm of driving parts that drive said photosensitive bodies on the basis of the judgment results of said means for judging the amount of positional deviation in the transfer positions so that the linear velocities of said photosensitive bodies are caused to agree with each other.

An image forming device of the present invention comprises a plurality of image carriers which carry visible images on moving surfaces; driving means which individually drives the respective image carriers; visible image forming means which forms visible images on the respective image carriers; an endless moving body whose surface is caused to move endlessly so as to successively pass through positions facing the respective image carriers; transfer means which transfers the visible images formed on the surfaces of the respective image carriers onto a recording medium held on the surface of said endless moving body, or which transfers said images onto the surface of said endless moving body, and then transfers said images onto the recording medium; image detection means which detects the visible images carried on the surface of said endless moving body; and control means which performs speed setting processing of forming specified reference images on the respective image carriers at a specified timing, transferring these reference images onto the surface of said endless moving body, calculating the relative amount of mutual positional deviation in the respective reference images on the basis of the timing at which the respective reference images are detected by said image detection means, and individually setting the driving speeds of the respective image carriers on the basis of said calculation results. The control means is constructed so that the driving speeds of the respective image carriers are individually set within a range in which the driving speed differences between the respective image carriers are kept at a specified upper limit value or lower.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Embodiments of the present invention will be described in detail below.

First Embodiment

A first embodiment of the present invention will be described in detail with reference to FIGS. 1 through 5.

Figure 1:
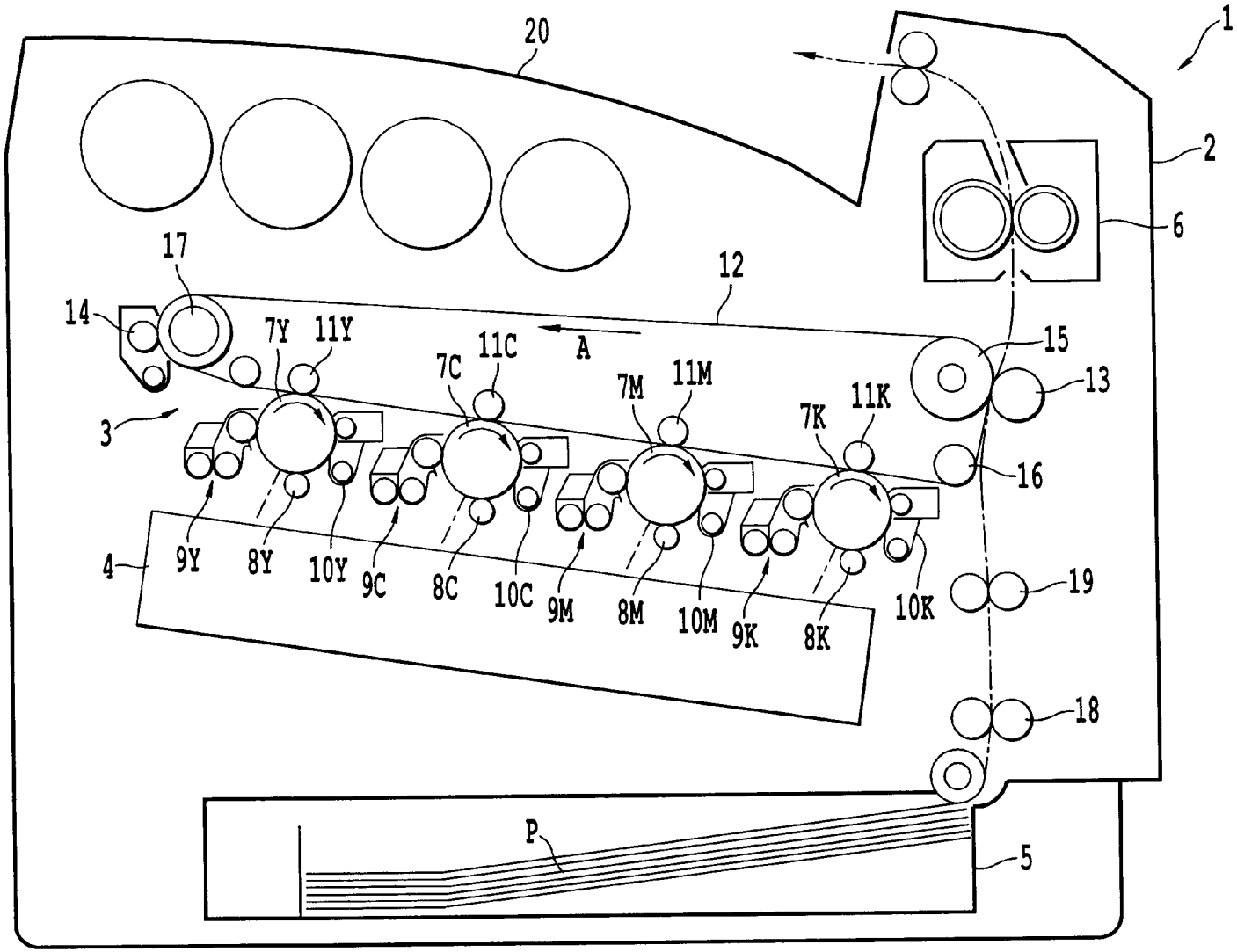
FIG. 1 is a longitudinally sectional side view showing the schematic construction of a color printer constituting a first embodiment of the present invention.

FIG. 1 shows the schematic construction of an electrophotographic type color printer 1 (hereafter referred to simply as a "printer") which is an image forming device constituting the present embodiment. A printer engine 3, an optical writing device 4 which emits a light beam, a paper supply cassette 5 which is a recording medium accommodating part that accommodates a recording medium P, a fixing device 6 which performs a fixing treatment on the recording medium P onto which toner images have been transferred, and the like, are disposed inside a main body case 2 of this printer 1.

The printer engine 3 is a part which forms toner images and transfers the formed toner images onto the recording medium P; this printer engine 3 is constructed from four photosensitive bodies 7, charging rollers 8 which are disposed on the circumferences of the respective photosensitive bodies 7, developing units 9, cleaning units 10, primary transfer rollers 11, an intermediate transfer belt 12 which is an endless belt, a secondary transfer roller 13, a cleaning unit 14 and the like. Here, in the present specification and drawings, the appended characters Y, C, M and K respectively indicate the colors of yellow, cyan, magenta and black; these appended characters are assigned as needed.

The photosensitive bodies 7 are formed in a cylindrical shape, and are connected to a driving motor (described later); the photosensitive bodies 7 are caused to rotate about the center lines thereof by the driving force from this driving motor. Photosensitive layers in which electrostatic latent images are formed are disposed on the outer circumferential surfaces of the photosensitive bodies 7.

The charging rollers 8 are disposed in contact with the outer circumferential surfaces of the photosensitive bodies 7, or are disposed with a slight gap between these charging rollers 8 and the outer circumferential surfaces of the photosensitive bodies 7. A corona discharge is generated between these charging rollers 8 and the photosensitive bodies 7 as a result of a voltage being applied to the charging rollers 8 by a power supply part (not shown in the figures), so that the outer circumferential surfaces of the photosensitive bodies 7 are uniformly charged.

The optical writing device 4 emits a light beam in accordance with image data, and exposes the uniformly charged outer circumferential surfaces of the photosensitive bodies 7. As a result of this exposure, electrostatic latent images corresponding to the abovementioned image data are formed on the outer circumferential surfaces of the photosensitive bodies 7.

The developing units 9 supply a toner to the photosensitive bodies 7. The supplied toner adheres to the electrostatic latent images formed on the outer circumferential surfaces of the photosensitive bodies 7, so that the electrostatic latent images on the outer circumferential surfaces of the photosensitive bodies 7 are made sensible as toner images.

The intermediate transfer belt 12 is a loop-form belt which is formed using a resin film or rubber as a base material; the intermediate transfer belt 12 is mounted around a driving roller 15, an entry roller 16 and a tension roller 17, and is caused to run in the direction indicated by the arrow A as a result of the driving roller 15, which is connected to the driving motor described later, being rotationally driven. The entry roller 16 and tension roller 17 are caused to rotate as driven rollers by the frictional force with the intermediate transfer belt 12 as a result of the intermediate transfer belt 12 running in the direction indicated by the arrow A.

The primary transfer rollers 11 are disposed on the side of the inner circumferential surface of the intermediate transfer belt 12 (i.e., the inside of the loop); the toner images on the respective photosensitive bodies 7 are transferred onto the intermediate transfer belt 12 as a result of a transfer voltage being applied to these primary transfer rollers 11. The toner images formed on the respective photosensitive bodies 7 are successively transferred and superimposed on the intermediate transfer belt 12 by the action of these primary transfer rollers 11, so that a color toner image is formed on the intermediate transfer belt 12.

The cleaning units 10 clean the outer circumferential surfaces of the photosensitive bodies 7 after the toner images have been transferred onto the intermediate transfer belt 12. Toner remaining on the outer circumferential surfaces of the photosensitive bodies 7 following the transfer of the toner images onto the intermediate transfer belt 12, as well as paper debris and the like, are removed by this cleaning.

The color toner image that is formed on the intermediate transfer belt 12 is transferred onto the recording medium P as a result of a transfer voltage being applied to the secondary transfer roller 13 at the timing at which the recording medium P is fed into the transfer position where the intermediate transfer belt 12 and secondary transfer roller 13 are caused to contact each other. The recording medium P is supplied from inside the paper supply cassette 5, and is conveyed by conveying rollers 18 and resist rollers 19, so that this recording medium P is conveyed into the fixing device 6 after the toner images have been transferred onto the recording medium P. Inside the fixing device 16, the recording medium P onto which the toner images have been transferred is subjected to a fixing treatment by the application of heat and pressure, and the toner images that are fused by this fixing treatment are fixed on the recording medium P. The recording medium P for which the fixing treatment has been completed is discharged onto a paper discharge tray 20 which is a recording medium discharge part formed on the upper surface part of the main body case 2.

The cleaning unit 14 cleans the outer circumferential surface of the intermediate transfer belt 12 after the color toner image has been transferred onto the recording medium P. Toner remaining on the outer circumferential surface of the intermediate transfer belt 12 following the transfer of the toner image, as well as paper debris and the like, are removed by this cleaning.

Figure 2:
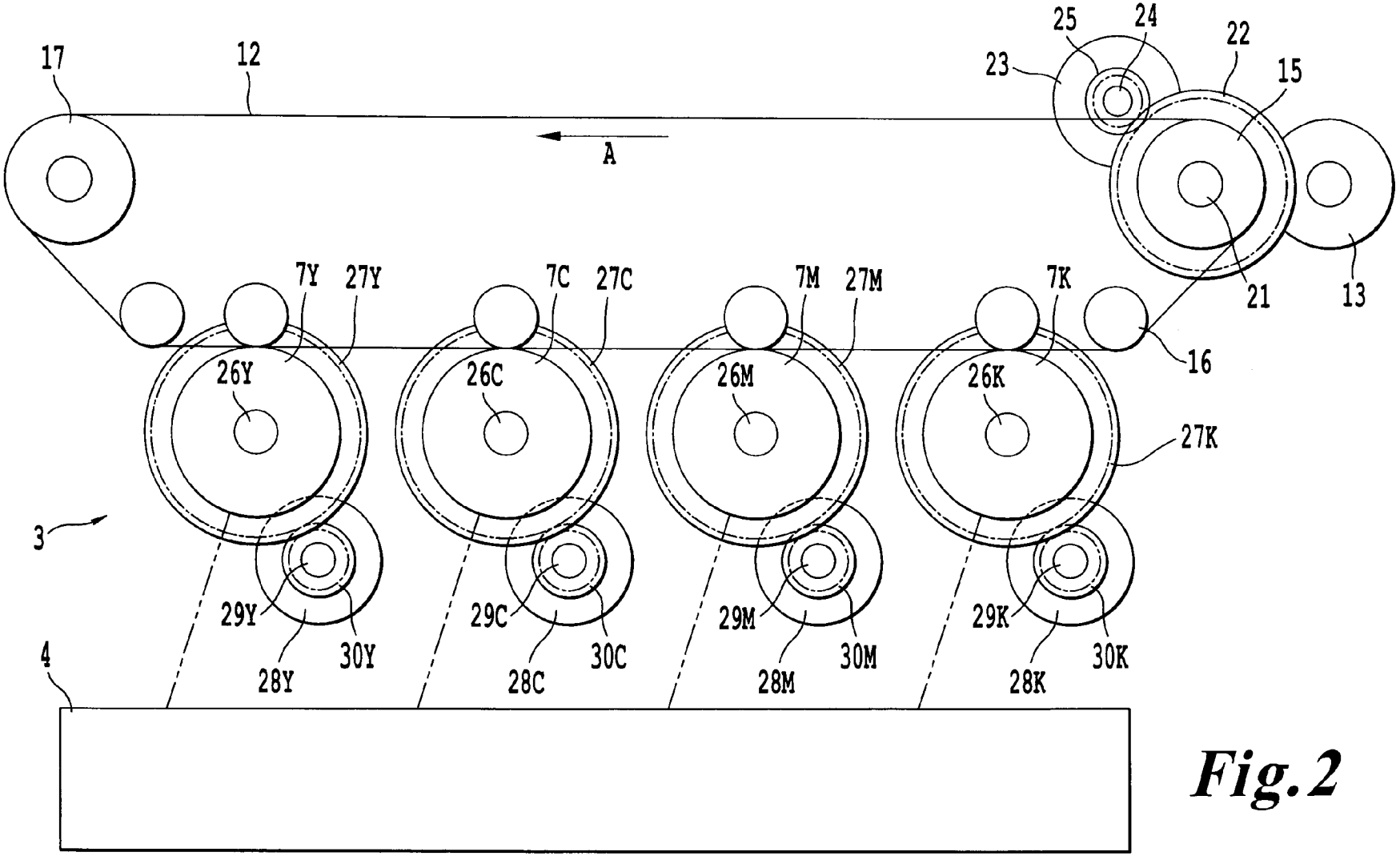
FIG. 2 is a side view showing the driving structure of the photosensitive bodies and intermediate transfer belt in the printer engine of the same color printer.

FIG. 2 shows the driving structure of the photosensitive bodies 7 and intermediate transfer belt 12 in the printer engine 3. A roller gear 22 which is fastened to the roller shaft 21 of the driving roller 15 is disposed on one end of the driving roller 15. The roller gear 22 engages with a motor gear 25 which is fastened to the motor shaft 24 of a driving motor 23, so that a rotational driving force is transmitted to the driving roller 15 from the driving motor 23.

The respective photosensitive bodies 7 are detachably attached to rotating shafts 26, and photosensitive body gears 27 are fastened to the end parts of the rotating shafts 26. These photosensitive body gears 27 engage with motor gears 30 which are fastened to the motor shafts 29 of driving motors 28 that are driving parts installed corresponding to the respective photosensitive bodies 7, so that a rotational driving force is transmitted to the respective photosensitive bodies 7 from the respective driving motors 28. Stepping motors which allow high-precision rpm control are used as these driving motors 28 and as the driving motor 23 that drives the intermediate transfer belt 12.

The running speed of the intermediate transfer belt 12 in the direction indicated by the arrow A is set so that this speed is slightly faster than the linear velocity of the outer circumferential surfaces of the respective photosensitive bodies 7. As a result, the generation of slack in the intermediate transfer belt 12 between the respective photosensitive bodies 7 is prevented.

Figure 3:
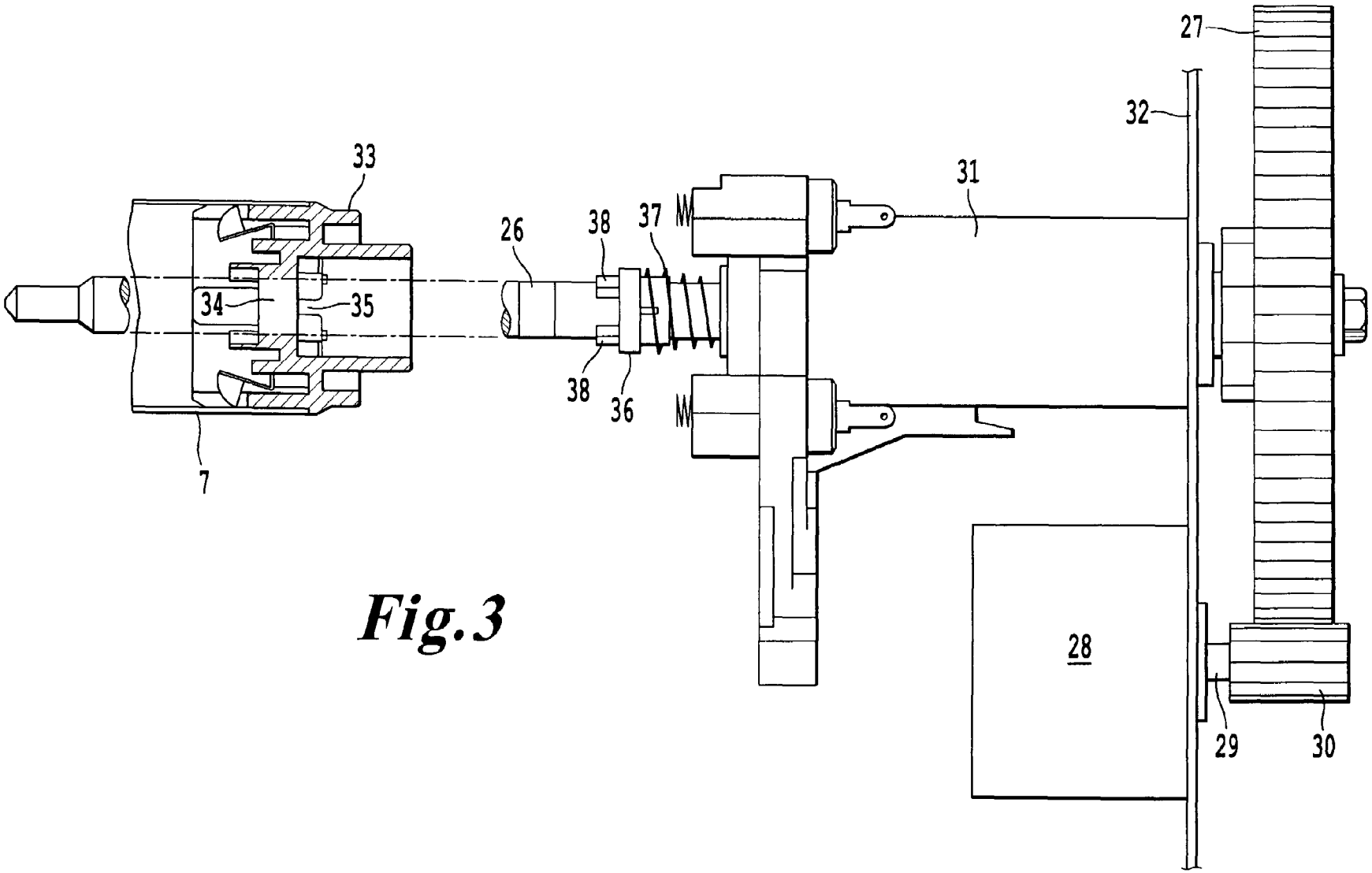
FIG. 3 is a longitudinally sectional front view showing the attachment/detachment structure of the photosensitive bodies.

FIG. 3 shows an attachment/detachment structure of the photosensitive bodies 7. Furthermore, the attachment/detachment structure of the photosensitive bodies 7 is the same for all of the photosensitive bodies 7, and will therefore be described by indicating only a single photosensitive body 7. One end of the rotating shaft 26 to which each photosensitive body 7 is detachably attached is held by a holding part 31, and this holding part 31 is held by a holding plate 32 disposed inside the main body case 2.

Flanges 33 are joined to both ends of the photosensitive body 7, and insertion holes 34 through which the rotating shaft 26 is removably inserted are formed in these flanges 33. A plurality of grooves 35 constituting engaging parts are formed along the circumferential direction in the inner circumferential part of one flange 33, i.e., the flange 33 that is located on the side of the holding part 31 when the photosensitive body 7 is attached to the rotating shaft 26. Meanwhile, a joint 36 is joined to the end part on the side that is held by the holding part 31 in the rotating shaft 26. This joint 36 rotates as an integral part of the rotating shaft 26, and is devised so that the joint 36 can slide in the axial direction of the rotating shaft 26; here, the joint 36 is driven toward the tip end of the rotating shaft 26 by a spring 37. A plurality of claws 38 constituting engaging parts are formed on the joint 36 along the circumferential direction; when the photosensitive body 7 is attached to the rotating shaft 26, the claws 38 engage with the grooves 35, so that the rotating shaft 26 and photosensitive body 7 can rotate as an integral unit.

In each photosensitive body 7, the transmission of a rotational driving force from the rotating shaft 26 to the photosensitive body 7 is made possible as a result of the fact that the rotating shaft 26 is passed through the central part of the photosensitive body 7, and the claws 38 and grooves 35 are engaged. Furthermore, the engagement of the claws 38 and grooves 35 can be released, so that the photosensitive body 7 can be removed, by sliding the photosensitive body 7 toward the tip end of the rotating shaft 26 along the direction of the center line of the rotating shaft 26. As a result, replacement of the photosensitive body 7 can easily be accomplished, so that the operating characteristics and service characteristics can be improved.

Figure 4:
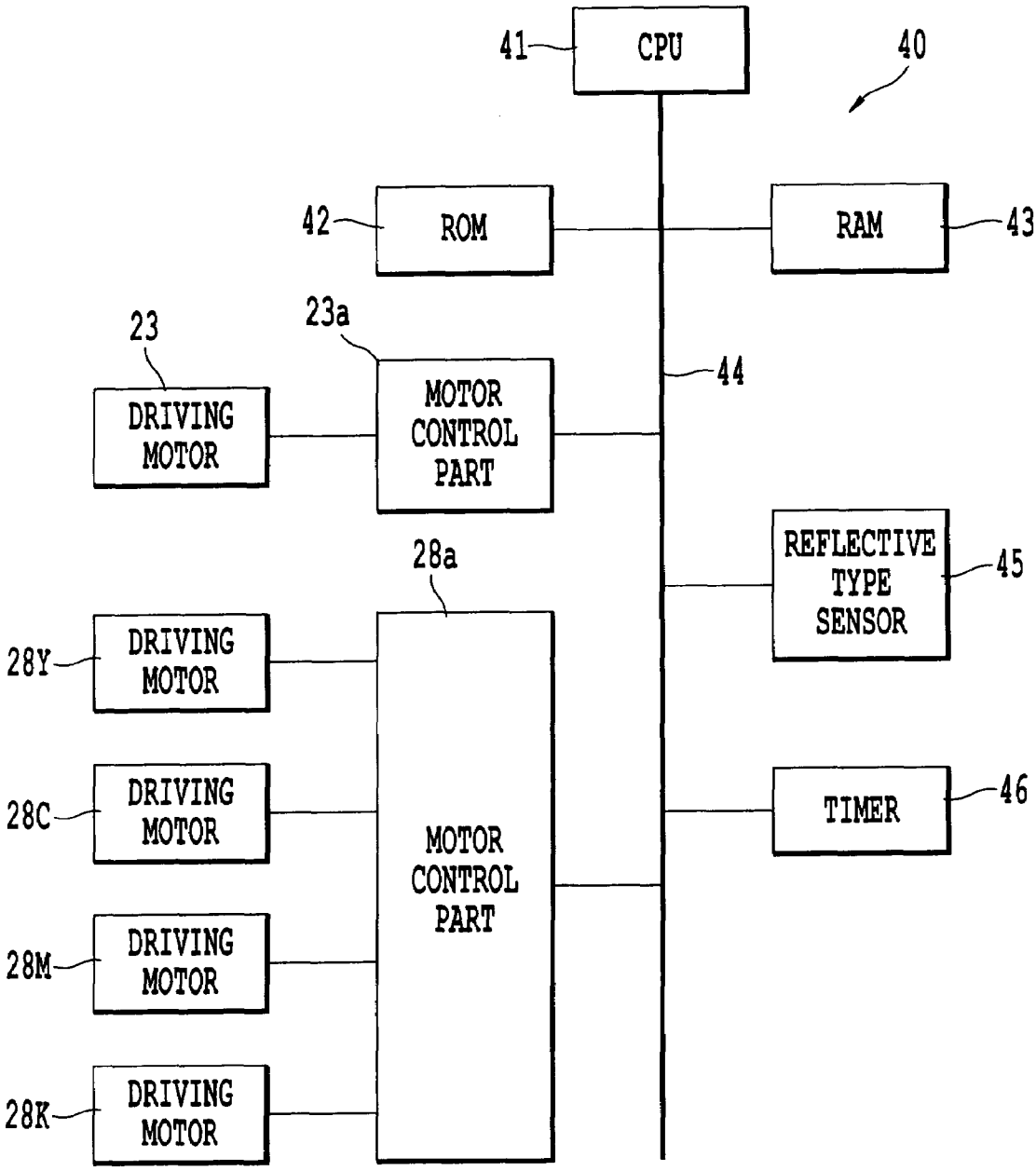
FIG. 4 is a block diagram showing in schematic form the electrical connections of the respective parts of the same color printer.

FIG. 4 shows in schematic form the electrical connections of the respective parts of the printer 1. This printer 1 has a controller 40 for controlling the respective parts, and this controller 40 is constructed by connecting a CPU (central processing unit) 41 that controls the respective parts in a concentrated manner, a ROM (read only memory) 42 that stores various programs and the like that are executed by the CPU 41, a RAM (random access memory) 43 that functions as a work area for the CPU 41, and the like, by means of a bus line 44. Furthermore, the driving motor 23 (with a motor control part 23*a* interposed), the driving motors 28 (28Y, 28C, 28M and 28K) (with a motor control part 28*a* interposed), a reflective type sensor 45, a timer 46 and the like are connected to the CPU 41. The reflective type sensor 45 functions as means of detecting the detection pattern toner images that are transferred onto the intermediate transfer belt 12 when such detection pattern toner images (used to detect the amount of positional deviation in the transfer positions of the respective color toner images when these toner images formed on the photosensitive bodies 7 are superimposed and transferred onto the intermediate transfer belt 12) are formed on the photosensitive bodies 7, and these detection pattern toner images are transferred onto the intermediate transfer belt 12.

Figure 5:
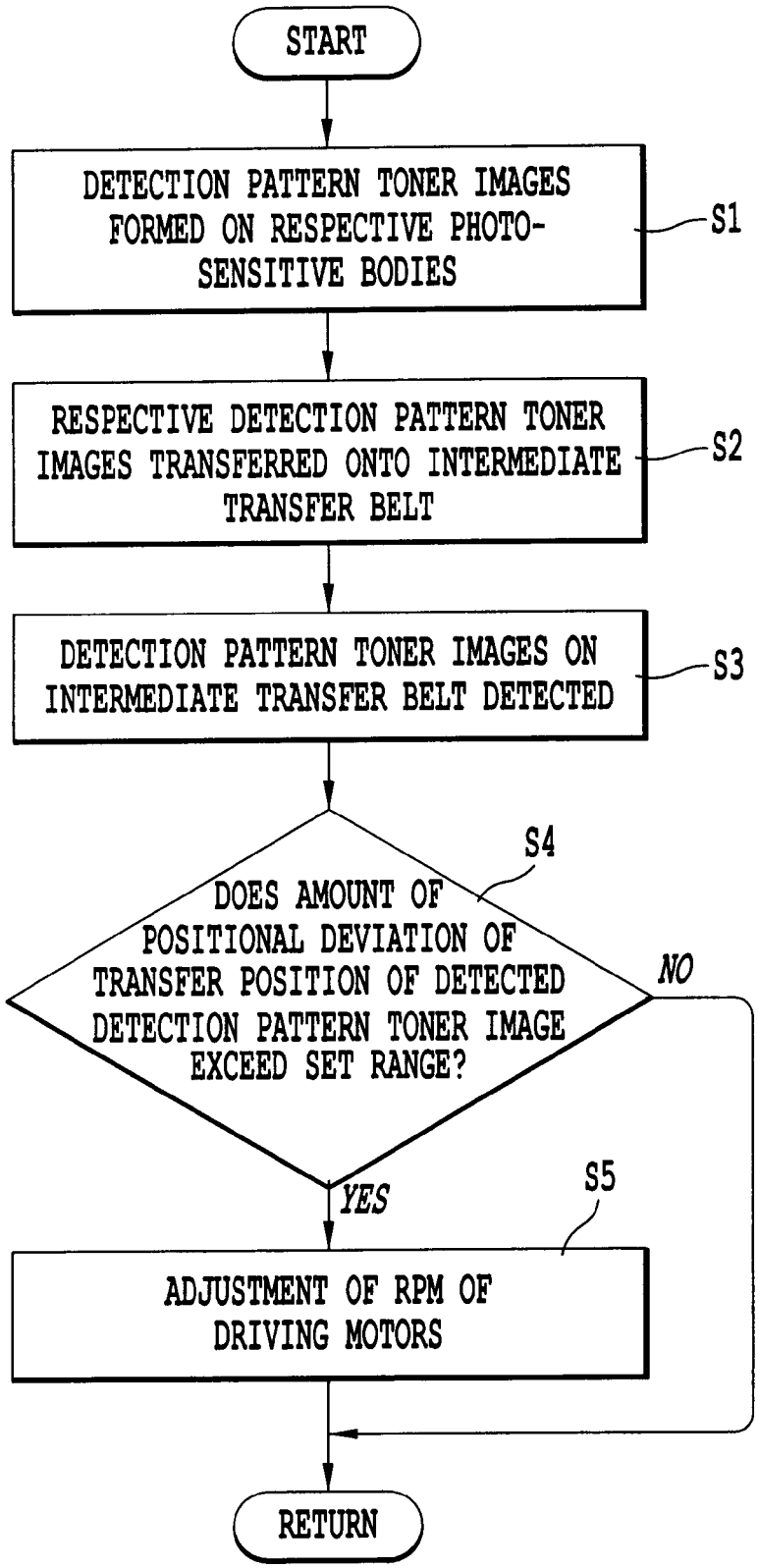
FIG. 5 is a flow chart illustrating the control in which the amount of positional deviation in the transfer positions that occurs when the detection pattern toner images formed on the respective photosensitive bodies are transferred onto the intermediate transfer belt is detected, and the linear velocities of the photosensitive bodies are adjusted in accordance with the detection results so that the positional deviation of the transfer positions is eliminated.

FIG. 5 is a flow chart illustrating the control in which the amount of positional deviation that occurs in the transfer positions when the detection pattern toner images formed on the respective photosensitive bodies 7 are transferred onto the intermediate transfer belt 12 is detected, and the linear velocity of the photosensitive bodies 7 is adjusted in accordance with these detection results so that the positional deviation of the transfer positions is eliminated.

First, immediately after the power supply is switched on, or at a preset timing such as following the formation of a specified number of images, detection pattern toner images are formed on the respective photosensitive bodies 7 (step 1; "step" is hereafter indicated as "S"); here, means for forming detection pattern toner images on the respective photosensitive bodies 7 is operated. The formation of these detection pattern toner images is accomplished by the same process as that used for the formation of ordinary toner images; specifically, this is accomplished by forming electrostatic latent images on the surfaces of the photosensitive bodies 7 by charging the surfaces of the photosensitive bodies 7, and developing these electrostatic latent images by means of a toner that is supplied from the developing units 9.

The detection pattern toner images that are formed on the respective photosensitive bodies 7 are transferred onto the intermediate transfer belt 12 at the same timing (S2); here, means which transfers the detection pattern toner images formed on the respective photosensitive bodies 7 onto the intermediate transfer belt 12 is operated. The detection pattern toner images of the respective colors that are transferred onto the intermediate transfer belt 12 are disposed at a specified spacing on a straight line along the running direction of the intermediate transfer belt 12.

As the intermediate transfer belt 12 runs, the detection pattern toner images that have been transferred onto the intermediate transfer belt 12 pass through a position that faces the reflective type sensor 45, and are detected by the reflective type sensor 45 during this passage (S3).

On the basis of the detection results for the detection pattern toner images of the respective colors obtained by the reflective type sensor 45, a judgment is made as to whether or not the amount of deviation in the detected spacing of the respective detection pattern toner images is within a set range, i.e., as to whether or not the amount of positional deviation in the transfer positions of the respective colors when the respective detection pattern toner images are superimposed and transferred exceeds this set range (S4); here, means that judges the amount of positional deviation in the transfer positions of the detection pattern toner images of the respective colors is operated.

In cases where the amount of positional deviation judged in step S4 exceeds the set range, the rpm values of the driving motors 28 that rotationally drive the photosensitive bodies 7 are adjusted so that this amount of positional deviation is eliminated (S5), and as the rpm values of the driving motors 28 are adjusted, an adjustment is performed so that the linear velocities of the respective photosensitive bodies 7 agree with each other; here, means that adjusts the rpm values of the driving motors 28 so that the linear velocities of the respective photosensitive bodies 7 are caused to agree is operated. In the present embodiment, the adjustment of the linear velocities of the respective photosensitive bodies 7 in step S5 is respectively performed using the photosensitive body 7K on which a black toner image is formed as a reference for the three photosensitive bodies 7Y, 7C and 7M on which the toner images of the other colors are formed. The adjustment of the linear velocities of the three photosensitive bodies 7Y, 7C and 7M is accomplished by independently adjusting the rpm values of the respective driving motors 28Y, 28C and 28M that rotationally drive these photosensitive bodies 7Y, 7C and 7M.

By adjusting the rpm values of the driving motors 28 in this way so that the linear velocities of the respective photosensitive bodies 7 are caused to agree, it is possible to prevent positional deviation of the transfer positions when the respective color toner images formed on the respective photosensitive bodies 7 are transferred. As a result, positional deviation of the transfer positions caused by differences in the linear velocities of the respective photosensitive bodies 7 can be eliminated, so that high-quality color images can be obtained in which there is no positional deviation of the transfer positions when the respective color toner images are transferred.

Furthermore, since the linear velocities of the respective photosensitive bodies 7 are independently adjusted so that these linear velocities are caused to agree with the linear velocity of the photosensitive body 7K as in the present embodiment, alignment of the transfer positions of the respective color toner images can be accomplished with a high degree of precision.

A first modification of this first embodiment will be described with reference to FIGS. 6 and 7. Furthermore, parts that are the same as parts in FIGS. 1 through 5 are indicated by the same symbols, and a description of such parts is omitted (the same is true of the respective modifications described below).

Figure 6:
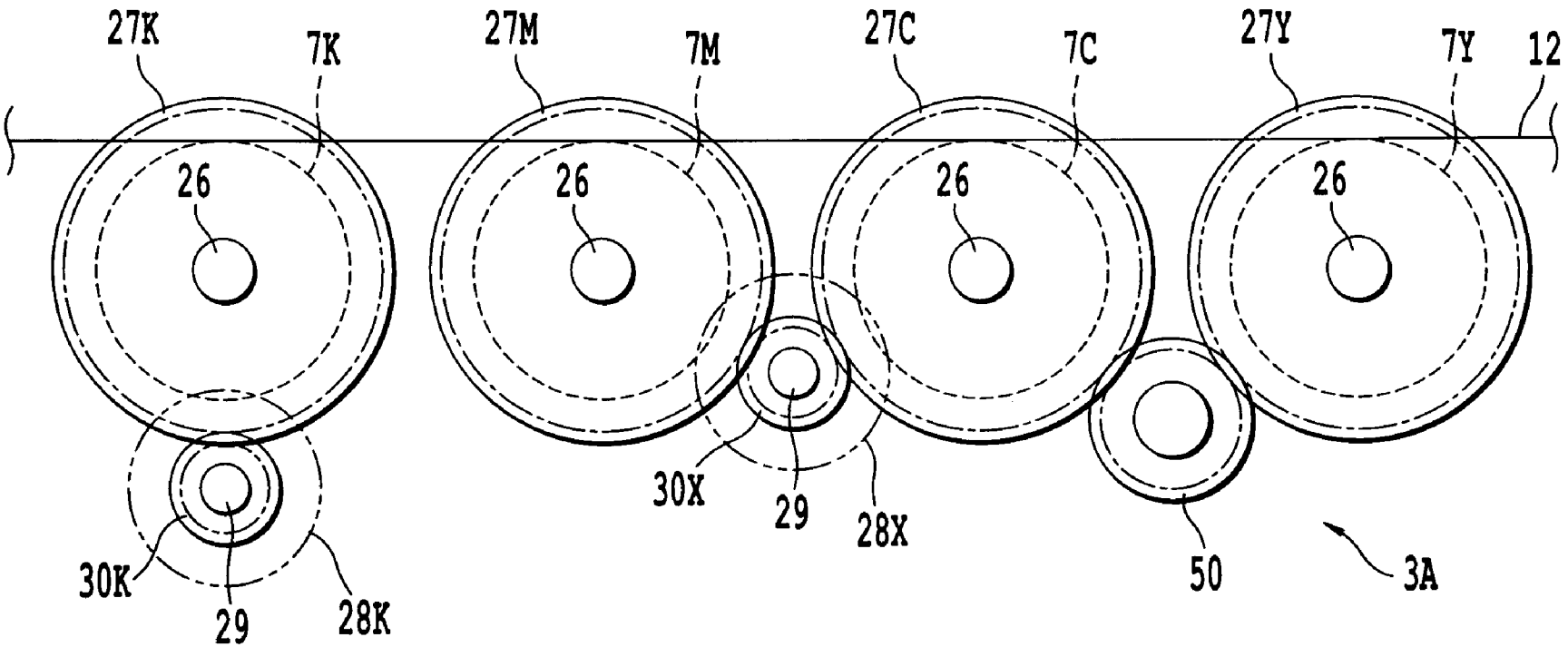
FIG. 6 is a side view showing the driving structure of the photosensitive bodies in a printer engine constituting a first modification of the present embodiment.

FIG. 6 shows the driving structure of photosensitive bodies 7 in a printer engine 3A. The basic structure of the printer engine 3A of this first modification is substantially the same as that of the printer engine 3 of the first embodiment described above. The difference is that there are two driving motors 28 that rotationally drive the photosensitive bodies 7. Specifically, one driving motor is a driving motor 28K that rotationally drives the photosensitive body 7K on which a black toner image is formed, and the other driving motor is a driving motor 28X which is a driving part that rotationally drives the photosensitive bodies 7Y, 7C and 7M.

The motor gear 30K that is fastened to the motor shaft 29 of the driving motor 28K engages with a photosensitive body gear 27K that is fastened to the rotating shaft 26 of the photosensitive body 7K. The motor gear 30X that is fastened to the motor shaft 29 of the driving motor 28X engages with a photosensitive body gear 27M that is fastened to the rotating shaft 26 of the photosensitive body 7M, and a photosensitive body gear 27C that is fastened to the rotating shaft 26 of the photosensitive body 7C. Furthermore, an idler gear 50 engages with the photosensitive body gear 27C and a photosensitive body gear 27Y that is fastened to the rotating shaft 26 of the photosensitive body 7Y.

Figure 7:
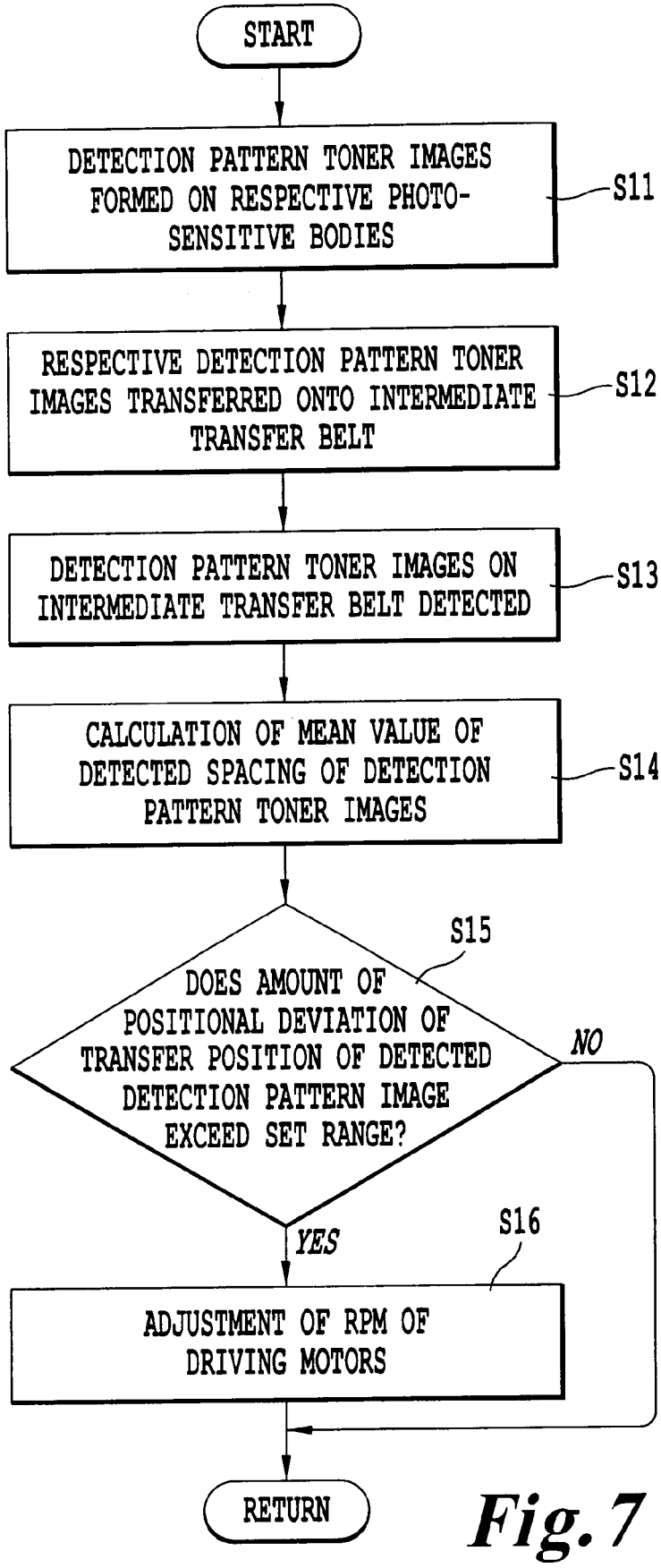
FIG. 7 is a flow chart illustrating the control in which the amount of positional deviation in the transfer positions that occurs when the toner images formed on the respective photosensitive bodies are transferred onto the intermediate transfer belt is detected, and the linear velocities of the photosensitive bodies are adjusted in accordance with the detection results so that the positional deviation is eliminated.

FIG. 7 is a flow chart illustrating the control in which the amount of positional deviation of the transfer positions that occurs when the toner images formed on the respective photosensitive bodies 7 are transferred onto the intermediate transfer belt 12 is detected, and the linear velocities of the photosensitive bodies 7 are adjusted in accordance with these detection results so that the positional deviation is eliminated.

First, immediately after the power supply is switched on, or at a preset timing such as following the formation of a specified number of images, detection pattern toner images are formed on the respective photosensitive bodies 7 (S11); here, means for forming detection pattern toner images on the respective photosensitive bodies 7 is operated.

The detection pattern toner images formed on the respective photosensitive bodies 7 are transferred onto the intermediate transfer belt 12 at the same timing (S12); here, means for transferring the detection pattern toner images formed on the respective photosensitive bodies 7 onto the intermediate transfer belt 12 is operated. The detection pattern toner images of the respective colors that are transferred onto the intermediate transfer belt 12 are disposed at a specified spacing on a straight line along the running direction of the intermediate transfer belt 12.

As the intermediate transfer belt 12 runs, the detection pattern toner images that have been transferred onto the intermediate transfer belt 12 pass through a position that faces the reflective type sensor 45, and these images are detected by the reflective type sensor 45 during this passage (S13).

On the basis of the detection results obtained for the detection pattern toner images of the respective colors by the reflective type sensor 45, the mean values of the detected spacing of the respective detection pattern toner images are calculated (S14). A judgment is made as to whether or not these mean values are within a set range, i.e., as to whether or not the amount of positional deviation of the transfer positions that occurs when the respective detection pattern toner images are superimposed and transferred exceeds a set range (S15). Here, means for judging the amount of positional deviation of the transfer positions of the detection pattern toner images of the respective colors is operated.

In cases where the amount of positional deviation judged in step S15 exceeds the set range, the rpm values of the driving motors 28 that rotationally drive the photosensitive bodies 7 are adjusted so that this amount of positional deviation is eliminated (S16). With this adjustment of the rpm values of the driving motors 28, an adjustment is made so that the linear velocities of the respective photosensitive bodies 7 are caused to agree. Here, means which performs an adjustment so that the linear velocities of the respective photosensitive bodies 7 are caused to agree is operated. The adjustment of the rpm values of the driving motors 28 performed in step S16 (i.e., the adjustment of the linear velocities of the photosensitive bodies 7) is accomplished by adjusting (using the linear velocity of the photosensitive body 7K on which a black toner image is formed as a reference) the rpm of the driving motor 28X which rotationally drives (as a unit) the three photosensitive bodies 7Y, 7C and 7M on which the toner images of the other colors are formed.

By thus adjusting the linear velocities of the respective photosensitive bodies 7 so that these linear velocities are caused to agree, it is possible to devise the system so that transfer positions of the toner images of the other colors undergo no positional deviation with respect to the black toner image when the toner images of the respective colors formed on the respective photosensitive bodies 7 are transferred. As a result, the positional deviation of the transfer positions of the toner images caused by differences between the linear velocity of the photosensitive body 7K on which the black toner image is formed and the linear velocities of the photosensitive bodies 7Y, 7C and 7M on which the toner images of colors other than black are formed can be eliminated, so that color images with a high image quality that show no positional deviation of the transfer positions during the transfer of the toner images of the respective colors can be obtained.

Furthermore, in the present modification, the positional deviation of the transfer positions cannot be adjusted for the individual toner images of the three colors yellow, cyan and magenta; however, the mean value of the positional deviation of the toner images of the three colors yellow, cyan and magenta relative to the black toner image can be reduced. As a result, the number of driving motors 28 can be reduced, and the structure used to position the transfer positions of the toner images can be simplified.

A second modification of this first embodiment will be described with reference to FIGS. 8 through 10.

Figure 8:
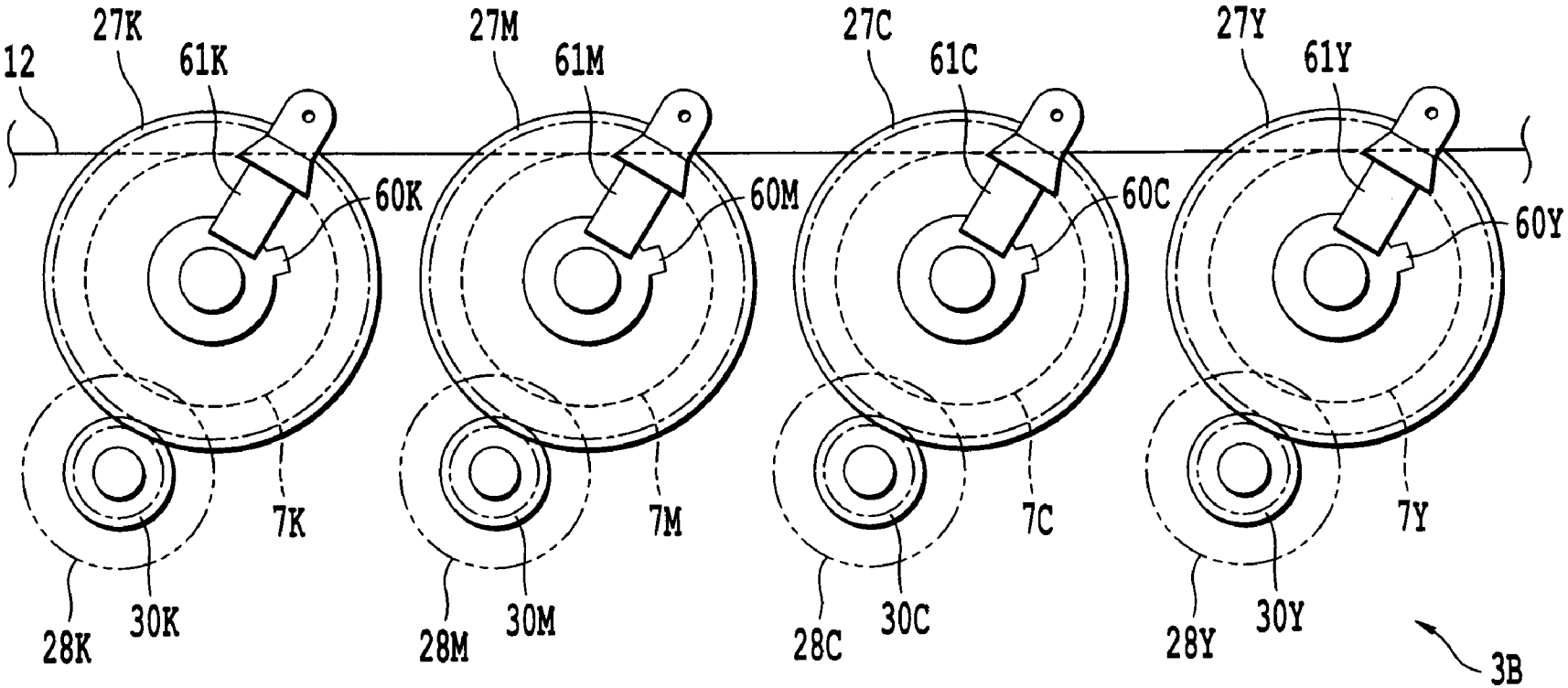
FIG. 8 is a side view showing the driving structure of the photosensitive bodies in a printer engine constituting a second modification of the present embodiment.

FIG. 8 shows the driving structure of the photosensitive bodies 7 in a printer engine 3B. The basic structure of the printer engine 3B of the present modification is the same as that of the printer engine 3 of the abovementioned first embodiment. In the printer engine 3B of the present modification, a construction is used in which projections 60 (60Y, 60C, 60M, 60K) constituting detected parts that are formed on the respective photosensitive body gears 27 (which are gears), and sensors 61 (61Y, 61C, 61M, 61K) which are positioned in the vicinity of the photosensitive body gears 27 and which detect the projections 60, are added. Reflective type sensors or the like are used as the sensors 61; these sensors 61 are positioned so that the sensors 61 detect the projections 60 once during each revolution of the photosensitive bodies 7.

Figure 9:
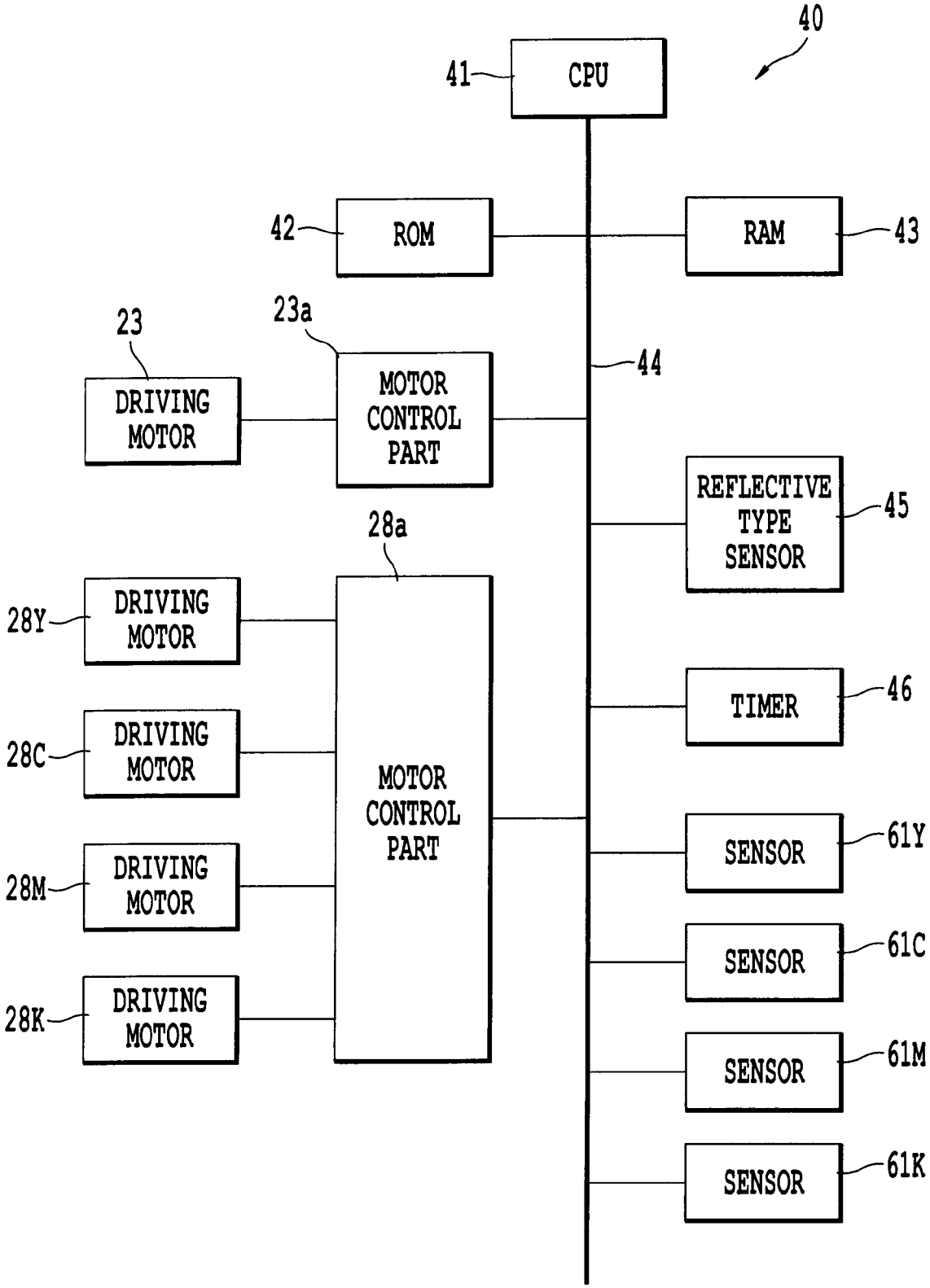
FIG. 9 is a block diagram showing in schematic form the electrical connections of the respective parts of the same color printer.

FIG. 9 shows (in schematic form) the electrical connections of the respective parts of this printer. This printer has a construction in which the sensors 61Y, 61C, 61M and 61K are added to the electrical connection structure shown in FIG. 4.

Figure 10:
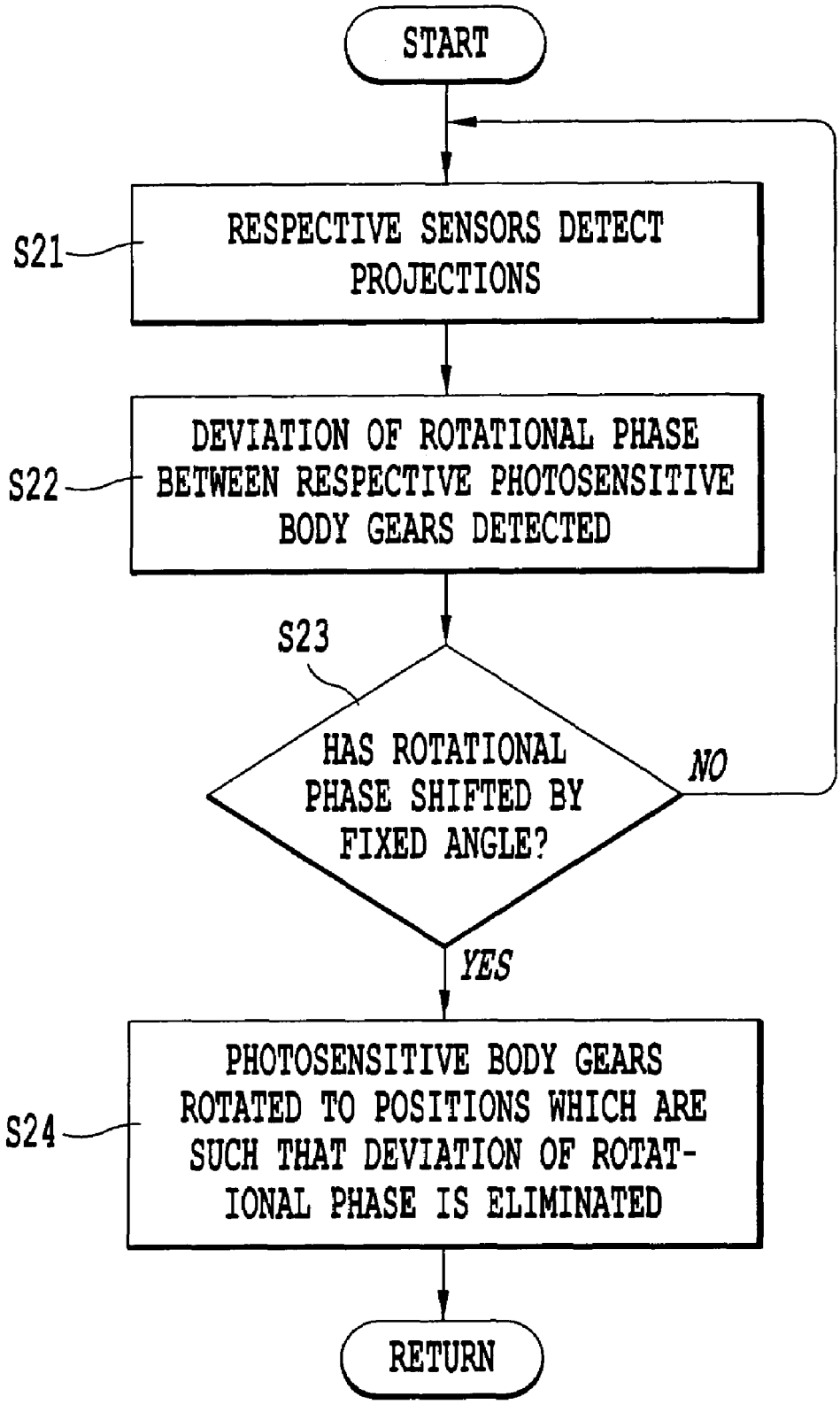
FIG. 10 is a flow chart illustrating the control in which a rotational phase deviation occurs between the photosensitive body gears of the driving structure of the photosensitive bodies of the same color printer, and when the rotational phase deviates by a fixed angle, the photosensitive body gears are rotated to positions which are such that this rotational phase deviation is eliminated.

FIG. 10 is a flow chart illustrating the control in which a deviation in rotational phase is generated between the respective photosensitive body gears 27, and when this rotational phase deviates by a fixed angle, the photosensitive body gears 27 are rotated to positions which are such that the deviation in the rotational phase is eliminated.

First, the image formation operation is initiated, and as the photosensitive body gears 27 rotate, the projections 60 are detected by the sensors 61 once during each revolution of the photosensitive body gears 27 (S21). Furthermore, the detection of the projections 60 is performed independently by the respective sensors 61 in the respective photosensitive body gears 27.

The respective timings at which the projections 60 are detected by the respective sensors 61 are compared, so that the rotational phase deviation between the respective photosensitive body gears 27 is detected (S22). Here, means for detecting the rotational phase deviation between the photosensitive body gears 27 on the basis of the detection results obtained by the sensors 61 is operated. Here, a deviation in the rotational phase between the respective photosensitive body gears 27 occurs as a result of the rotational speed of the photosensitive body gears 27 varying with the adjustment when the rpm values of the driving motors 28 are adjusted so that the linear velocities of the photosensitive bodies 7 are caused to agree (in order to position the transfer positions of the toner images of the respective colors). Furthermore, there may be cases in which the photosensitive body gears 27 formed by molding or the like are molded with their centers shifted, so that the linear velocities of photosensitive bodies 7 that are connected to such photosensitive body gears 27 in which the centers are shifted show a periodic fluctuation in each revolution of the photosensitive body gears 27, thus generating a positional deviation in the transfer positions that is caused by this periodic fluctuation, and causing color deviation in the toner images that are transferred.

On the basis of the detected deviation in the rotational phase between the respective photosensitive body gears 27, a judgment is made as to whether or not the rotational phase has shifted by a fixed angle (e.g., ±15°) (S23). Here, means which judges that the rotational phase between the photosensitive body gears 27 has shifted by a fixed angle is operated.

In cases where the rotational phase between the photosensitive body gears 27 has shifted by a fixed angle, the image formation operation is temporarily interrupted, and the photosensitive bodies 27 are rotationally driven by the driving motors 28 to positions which are such that the deviation in the rotational phases of the respective photosensitive body gears 27 is eliminated (S24). Here, means which drives the driving motors 28 so that the photosensitive body gears 27 are rotated to positions which are such that the deviation in the rotational phase between the photosensitive body gears 27 is eliminated is operated. Rotational driving of the photosensitive body gears 27 in this case may be performed only for the photosensitive body gears 27 whose rotational phase has shifted by a fixed angle, or may be performed for all of the photosensitive body gears 27.

Since an adjustment is thus made so that the deviation in the rotational phase is eliminated in cases where the rotational phase of the photosensitive body gears 27 has shifted by a fixed angle, the positional deviation of the transfer positions of the toner images which is caused by the shift in the rotational phase that is generated due to the shift of the centers of the photosensitive body gears 27 so that the photosensitive body gears 27 are caused to rotate at different rotational speeds can be prevented.

Next, a third modification of the present embodiment will be described with reference to FIG. 11.

Figure 11:
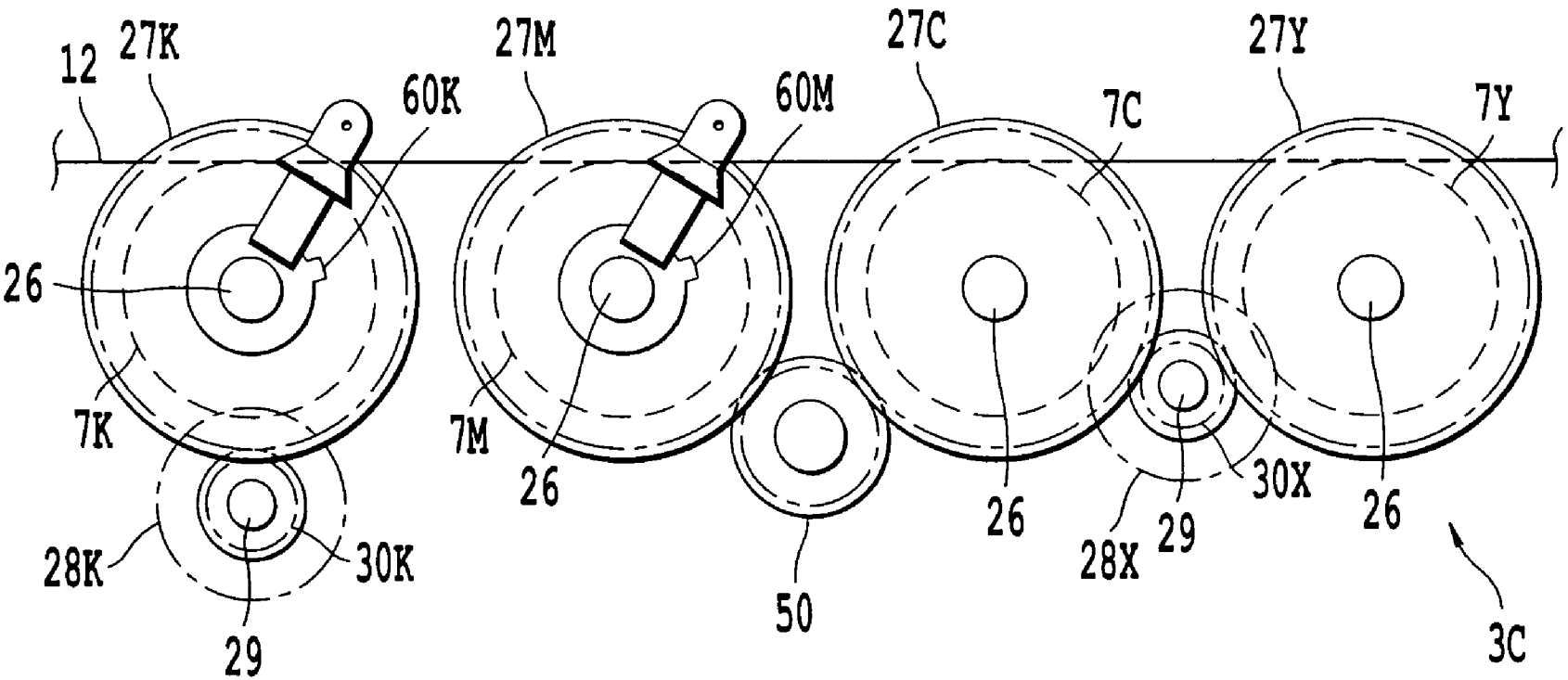
FIG. 11 is a side view showing the driving structure of the photosensitive bodies in a printer engine constituting a third modification of the present embodiment.

FIG. 11 shows the driving structure of the photosensitive bodies 7 in a printer engine 3C. The printer engine 3C of the present modification has two driving motors 28 that rotationally drive the photosensitive bodies 7 as described in the abovementioned first modification (FIG. 6); one of these driving motors 28 is a driving motor 28K that rotationally drives the photosensitive body 7K, while the other driving motor 28 is a driving motor 28X that rotationally drives the photosensitive bodies 7Y, 7C and 7M.

The motor gear 30K that is fastened to the motor shaft 29 of the driving motor 28K engages with the photosensitive body gear 27K that is fastened to the rotating shaft 26 of the photosensitive body 7K. The motor gear 30X that is fastened to the motor shaft 29 of the driving motor 28X engages with the photosensitive body gear 27Y that is fastened to the rotating shaft 26 of the photosensitive body 7Y, and the photosensitive body gear 27C that is fastened to the rotating shaft 26 of the photosensitive body 7C. Furthermore, an idler gear 50 engages with the photosensitive body gear 27C and the photosensitive body gear 27M that is fastened to the rotating shaft 26 of the photosensitive body 7M.

In the present modification, projections 60 (60K and 60M) constituting detected parts are formed only on the photosensitive body gear 27K that is connected to the photosensitive body 7K, and the photosensitive body gear 27M that is connected to the photosensitive body 7M. Furthermore, two sensors 61 (61K and 61M) that detect the projections 60 are positioned in close proximity to the photosensitive body gears 27K and 27M. Reflective type sensors or the like are used as the sensors 61, and these sensors 61 are positioned so that the sensors 61 detect the projections 60 one for each revolution of the photosensitive bodies 7.

Here, the three photosensitive body gears 27Y, 27C and 27M are rotationally driven by a common driving motor 28X; accordingly, no deviation in the rotational phase is generated among these photosensitive bodies 27Y, 27C and 27M. In the present modification, the deviation in the rotational phase of photosensitive body gears 27 is generated between the three photosensitive body gears 27Y, 27C and 27M on the one hand, and the photosensitive body gear 27K on the other hand.

In the present modification, control is performed which is substantially the same as that of the flow chart shown in FIG. 10. Accordingly, the content of this control will be described with reference to FIG. 10. First, the image formation operation is initiated, and as the photosensitive body gears 27K and 27M rotate, the projections 60K and 60M are detected by the sensors 61K and 61M once for each revolution of the photosensitive body gears 27K and 27M (step S21).

The deviation in the rotational phase between the two photosensitive body gears 27K and 27M is detected by comparing the timing at which the respective projections 60K and 60M are detected by the two sensors 61K and 61M (step S22). Here, means for detecting the deviation in the rotational phase between the photosensitive body gears 27K and 27M on the basis of the detection results obtained by the sensors 61K and 61M is operated. A deviation in the rotational phase between the photosensitive body gears 27 is generated as a result of the rotational speed of the photosensitive body gears 27 varying with the adjustment in cases where the rpm values of the driving motors 28K and 28X are adjusted so that the linear velocities of the photosensitive bodies 7 are caused to agree. Furthermore, there may be cases in which the photosensitive body gears 27 formed by molding or the like are molded with their centers shifted, so that the linear velocities of photosensitive bodies 7 that are connected to such photosensitive body gears 27 in which the centers are shifted show a periodic fluctuation in each revolution of the photosensitive body gears 27, thus generating a positional deviation in the transfer positions that is caused by this periodic fluctuation, and causing color deviation in the toner images that are transferred.

On the basis of the detected deviation in the rotational phase between the respective photosensitive body gears 27K and 27M, a judgment is made as to whether or not the rotational phase has shifted by a specified angle (e.g., ±15°) (step S23). Here, means for judging that the rotational phase between the photosensitive body gears 27K and 27M has shifted by a specified angle is operated.

In cases where the rotational phase between the photosensitive body gears 27K and 27M has shifted by a specified angle, the image formation operation is temporarily interrupted, and the photosensitive body gears 27 are rotationally driven by the driving motors 28 to a position where the deviation in the rotational phase between the photosensitive body gears 27 is eliminated (step S24). Here, means for driving the driving motors 28 so that the photosensitive body gears 27 are caused to rotate to a position where the deviation in the rotational phase between the photosensitive body gears 27 is eliminated is operated. In cases where the photosensitive body gears 27 are rotationally driven so that the deviation in the rotational phase is eliminated, either of the driving motors 28K or 28X may be driven.

In the present modification, since the three photosensitive bodies 7Y, 7C and 7M are rotationally driven by a common driving motor 28X, the number of sensors 61 used to detect the deviation in the rotational phase of the photosensitive body gears 27 can be reduced, so that the structure that is used to adjust the deviation in the rotational phase of the photosensitive body gears 27 can be simplified.

Next, a fourth modification of the first embodiment will be described with reference to FIG. 12.

Figure 12:
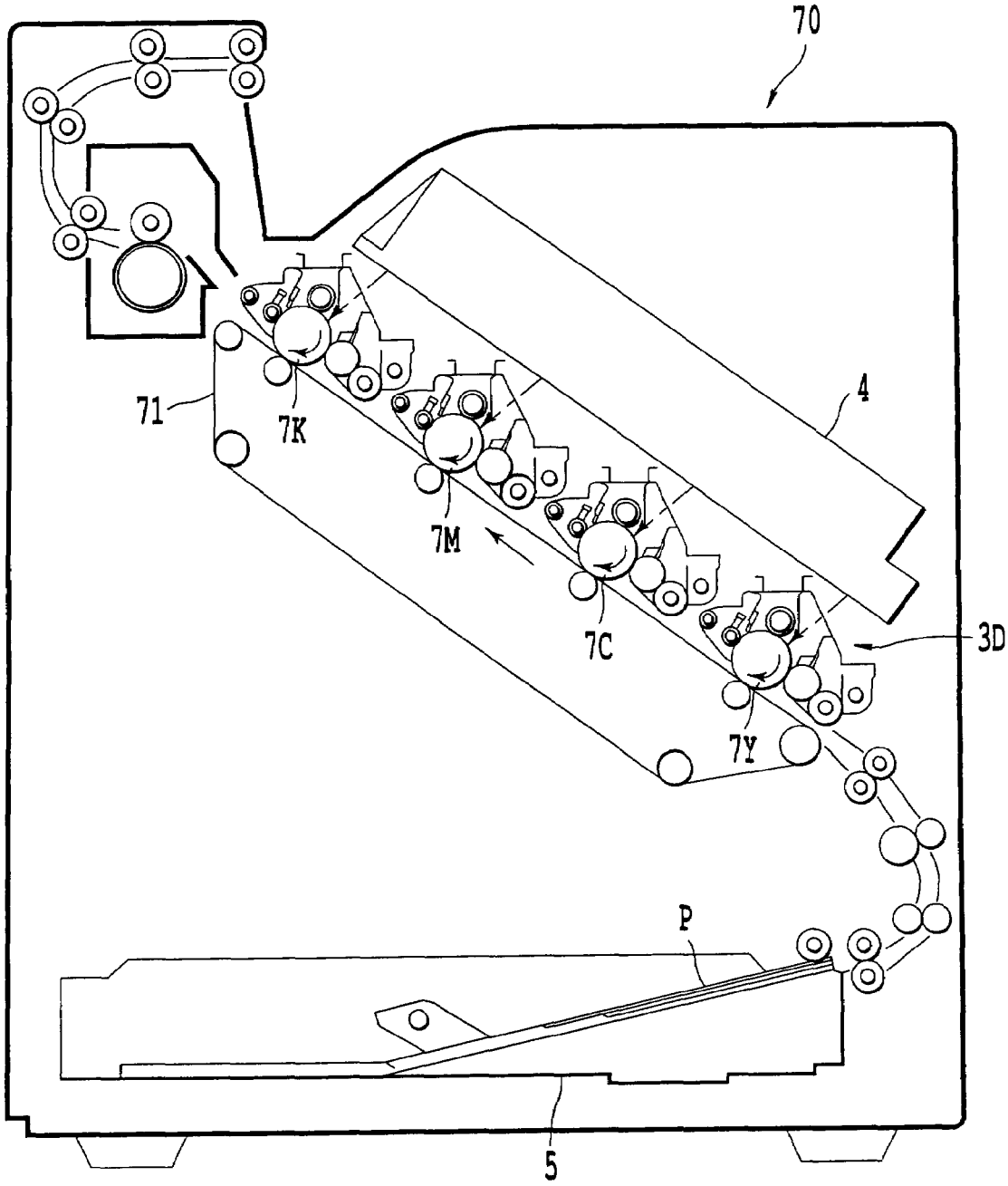
FIG. 12 is a longitudinally sectional side view which shows in schematic form a color printer constituting a fourth modification of the present embodiment.

FIG. 12 shows in schematic form the construction of a color printer 70 constituting a color image forming device. In the respective printer engines described above, an intermediate transfer belt 12 was used as the endless belt, while in a printer engine 3D of the color printer 70 of the present modification, a transfer conveyor belt 71 is used as the endless belt.

The transfer conveyor belt 71 holds and conveys a recording medium P that is supplied from a paper supply cassette 5; the toner images formed on the respective photosensitive bodies 7 are successively transferred onto the recording medium P that is thus conveyed, so that a color toner image is formed on this recording medium P.

In the present modification as in the abovementioned first embodiment, a plurality of driving motors that independently drive the respective photosensitive bodies 7 in a rotational manner are provided (although this is not shown in the figures), and means for forming detection pattern toner images on the photosensitive bodies 7 which are used to detect that amount of positional deviation of the transfer positions of the toner images of the respective colors that occurs when the toner images formed on the photosensitive bodies 7 are superimposed and transferred onto the recording medium P that is conveyed while being held on the transfer conveyor belt 71, means for transferring the detection pattern toner images formed on the respective photosensitive bodies 7 onto the recording medium P, a reflective type sensor used as means for detecting the detection pattern toner images transferred onto the recording medium P, means for judging the amount of positional deviation of the detection pattern toner images of the respective colors on the basis of the detection results obtained by the sensor, means for performing an adjustment on the basis of the judgment results of the means for judging the amount of positional deviation so that the linear velocities of the photosensitive bodies 7 are constant, and the like, are provided.

Furthermore, as was described in the abovementioned second modification, (FIGS. 8 through 10), photosensitive body gears which are connected to the respective photosensitive bodies 7, and which transmit a rotational driving force to the respective photosensitive bodies 7, projections constituting detected parts that are disposed on the respective photosensitive body gears, sensors that detect the respective projections, means for detecting the deviation in the rotational phase between the photosensitive body gears on the basis of the detection results obtained by the sensors, means for judging that the detected rotational phase between the photosensitive body gears has shifted by a fixed angle, means for causing the photosensitive body gears to rotate to a position where the deviation in the rotational phase between the photosensitive body gears is eliminated in cases where the rotational phase between the photosensitive body gears has shifted by a fixed angle, and the like, are provided.

Figure 13:
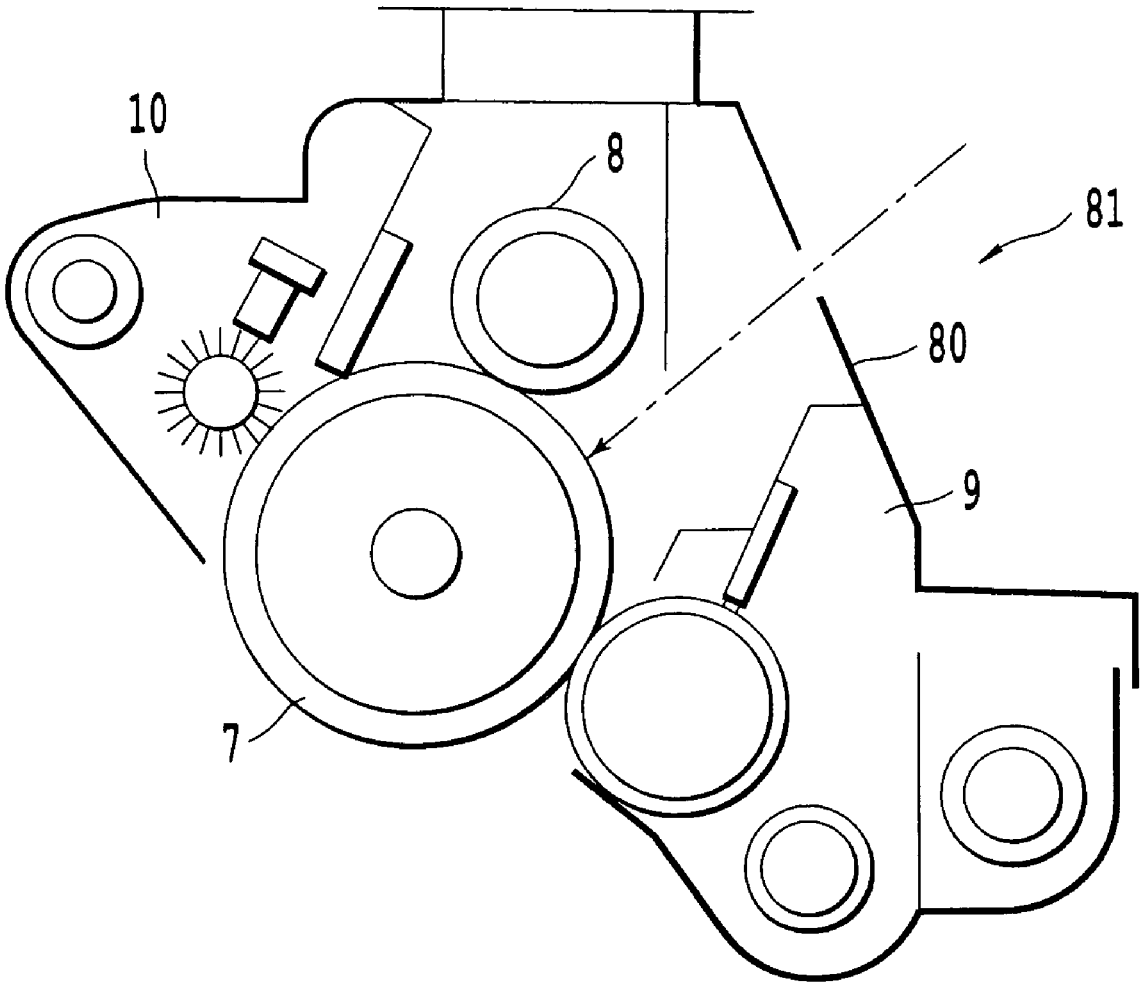
FIG. 13 is a longitudinally sectional side view showing a process cartridge constituting a fifth modification of the present embodiment.

Next, a fifth modification of the first embodiment of the present invention will be described with reference to FIG. 13.

In this modification, a process cartridge 81 in which a photosensitive body 7, charging roller 8, developing unit 9 and cleaning unit 10 are accommodated and unitized inside a case 80 is used in the printer engine. Such process cartridges 81 are mounted inside the main body case of the color image forming device in a detachable manner. Four process cartridges 81 which are used to form yellow, cyan, magenta and black toner images are provided; these process cartridges 81 are respectively mounted inside the main body case in a detachable manner.

At least the photosensitive bodies 7, charging rollers 8, developing units 9 and cleaning units 10 can be replaced as a unit by detaching the process cartridges 81 from the main body case; accordingly, replacement work can easily be accomplished, and the operating characteristics and service characteristics can be improved.

Furthermore, various process cartridge 81 constructions are possible; for instance, a construction in which only the photosensitive body 7 and charging roller 8 are accommodated and unitized inside the case 80, a construction in which the photosensitive body 7, charging roller 8 and cleaning unit 10 are accommodated and unitized inside the case 80, a construction in which the photosensitive body 7, charging roller 8 and developing unit 9 are accommodated and unitized inside the case 80, and the like, may be cited as examples. Process cartridges of one of these types are detachably mounted inside the main body case of the color image forming device.

Thus, if the first embodiment of the present invention and the modifications of the same are used, the following merits can be obtained.

(1) In cases where the transfer positions of the toner images of the respective colors formed on the respective photosensitive bodies show a positional deviation, the positional deviation of the transfer positions of the toner images on the respective photosensitive bodies can be eliminated by adjusting the rpm values of the driving part that drive the photosensitive bodies in accordance with the amount of positional deviation, thus making it possible to obtain color images with a high image quality in which the transfer positions of the toner images of the respective colors show no positional deviation.

(2) The linear velocities of a plurality of photosensitive bodies can be individually adjusted so that the linear velocities of the respective photosensitive bodies can be caused to agree with a high degree of precision, thus making it possible to position the transfer positions of the toner images of the respective colors with a high degree of precision.

(3) Since the number of driving parts used to position the transfer positions of the toner images of the four photosensitive bodies can be set at two driving parts, the number of driving parts used can be reduced.

(4) There are cases in which the gears that are connected to the photosensitive bodies are molded with their centers shifted, and the linear velocities of the photosensitive bodies show a periodic fluctuation for each revolution of the gear as a result of the center of the gear being shifted, so that the rotational phase between the gears connected to the respective photosensitive bodies is shifted as a result of the rpm values of the driving parts that drive the respective photosensitive bodies being adjusted. A positional deviation in the transfer positions of the toner images of the respective colors occurs as a result of this shift in the rotational phase. Accordingly, by causing the gears to rotate to positions which are such that the deviation in the rotational phase between these gears is eliminated in cases where the rotational phase between the respective gears has shifted by a fixed angle, it is possible to prevent positional deviation of the transfer positions of the toner images caused by a shift of the centers of the gears.

(5) There are cases in which the gears that are connected to the photosensitive bodies are molded with their centers shifted, and the linear velocities of the photosensitive bodies show a periodic fluctuation for each revolution of the gear as a result of the center of the gear being shifted, so that the rotational phase between the gear connected to the photosensitive body on which a black toner image is formed and the gears connected to the photosensitive bodies on which toner images of other colors are formed is shifted as a result of the rpm values of the driving parts that drive the respective photosensitive bodies being adjusted. A positional deviation in the transfer positions of the black toner image and the toner images of the other colors occurs as a result of this shift in the rotational phase. Accordingly, by causing the gears to rotate to positions which are such that the deviation in the rotational phase between these gears is eliminated in cases where the rotational phase between the gear connected to the photosensitive body on which a black toner image is formed and the gears connected to the photosensitive bodies on which toner images of the other colors are formed has shifted by a fixed angle, it is possible to prevent positional deviation of the transfer positions of the toner images caused by a shift of the centers of the gears.

(6) Replacement of the photosensitive bodies can easily be accomplished by sliding the photosensitive bodies in the direction of the center lines of the rotating shafts, and disengaging the engaging parts disposed on the rotating shafts from the engaging parts disposed on the photosensitive bodies.

(7) At least the photosensitive bodies and charging means can be replaced as a unit by detaching the process cartridges from the main body case, so that replacement work can easily be accomplished.

(8) Positional deviation of the transferred toner images can be prevented when the toner images formed on the respective photosensitive bodies are transferred onto the intermediate transfer belt.

(9) Positional deviation of the transferred toner images can be prevented when the toner images formed on the respective photosensitive bodies are transferred onto the recording medium that is held and conveyed by the transfer conveyor belt.

(10) Thus, a recording medium on which color images with a high image quality in which the transferred toner images of the respective colors show no color deviation can be output.

Second Embodiment

An electrophotographic type printer (hereafter referred to simply as a "printer") which is an image forming device constituting a second embodiment of the present invention will be described below.

First, the basic construction of this printer will be described.

Figure 14:
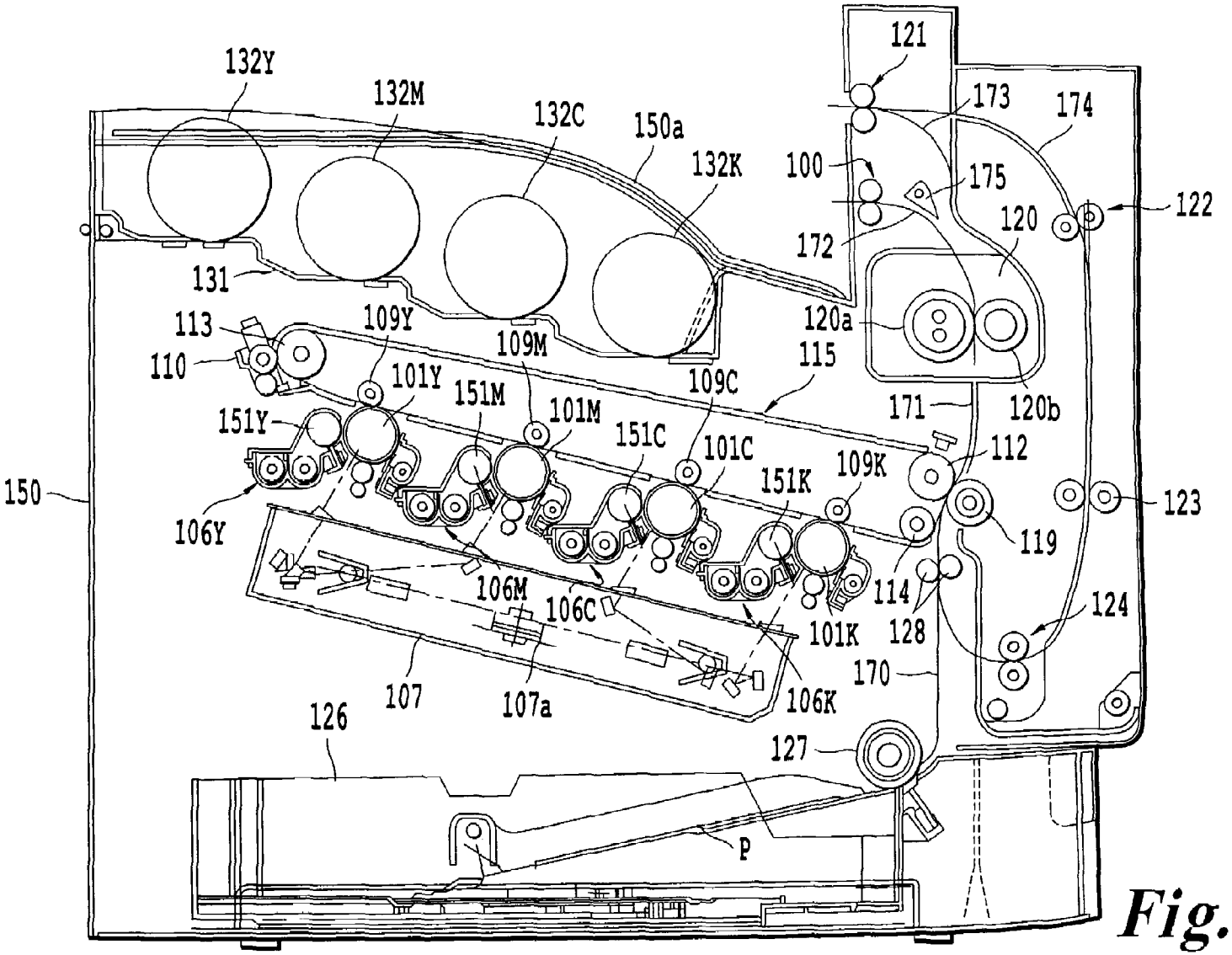
FIG. 14 is a diagram showing the schematic construction of a printer constituting a second embodiment of the present invention.
Figure 15:
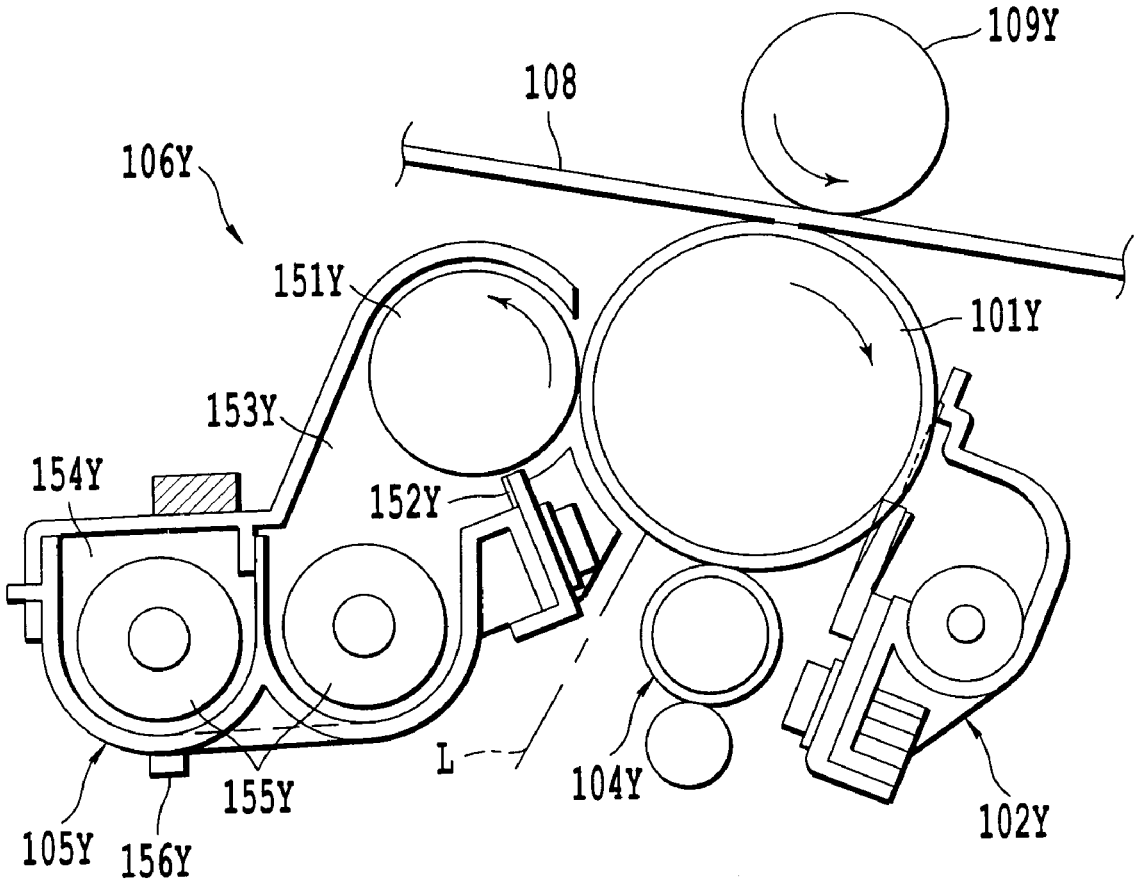
FIG. 15 is a diagram showing the Y process unit of the same printer, and the surrounding construction.

As is shown in FIG. 14, this printer comprises four process units 106Y, 106M, 106C and 106K which are used to produce toner images of the colors yellow, magenta, cyan and black (hereafter abbreviated as Y, M, C and K). These units use toners of the mutually different colors Y, M, C and K as image forming substances, but otherwise have the same construction, and are replaced when the useful life of these units expires. To take the process unit 106Y which is used to produce Y toner images as an example, this process unit comprises a drum-form photosensitive body 101Y, a drum cleaning unit 102Y, a de-charging unit (not shown in the figures), a charging unit 104Y, a developing unit 105Y and the like, as shown in FIG. 15. The process unit 106Y which constitutes an image forming unit can be detached from the printer main body, so that consumable parts can be replaced at one time.

The abovementioned charging unit 104Y uniformly charges the surface of the photosensitive body 101Y which is caused to rotate in the clockwise direction in the figures by driving means not shown in the figures. The uniformly charged surface of the photosensitive body 101Y constituting an image carrier is scanned in an exposure by laser light L, so that this surface carries an electrostatic latent image used for Y. This Y electrostatic latent image is developed into a Y toner image by the developing unit 105Y using a Y developing agent that contains a Y toner and a magnetic carrier. Then, this image is subjected to an intermediate transfer onto a intermediate transfer belt 108. The drum cleaning unit 102Y removes the toner that remains on the surface of the photosensitive body 101Y following the intermediate transfer process. Furthermore, the abovementioned de-charging unit de-charges the residual charge of the photosensitive body 101Y following cleaning. As a result of this de-charging, the surface of the photosensitive body 101Y is initialized and prepared for the next image formation process. In the process units (106M, 106C and 106K) for the other colors as well, toner images (M, C and K) are similarly formed on the photosensitive bodies (101M, 101C and 101K), and are transferred onto the intermediate transfer belt 108 in an intermediate transfer process.

The abovementioned developing unit 105Y has a developing roll 151Y which is disposed so that this developing roll 151Y is partially exposed via an opening in the casing of this developing unit 105Y. Furthermore, this developing unit 105Y also has two conveying screws 155Y that are disposed parallel to each other, a doctor blade 152Y, a toner concentration sensor (hereafter referred to as a "T sensor") 156Y and the like.

A Y developing agent (not shown in the figures) which contains a magnetic carrier and a Y toner is accommodated inside the casing of the developing unit 105Y. This Y developing agent is charged by friction while being agitated and conveyed by the two conveying screws 155Y, and is then carried on the surface of the abovementioned developing roll 151Y. Then, this Y developing agent is conveyed to a developing region facing the Y photosensitive body 101Y which the layer thickness of this developing agent is regulated by the doctor blade 152Y; here, the Y toner is caused to adhere to the electrostatic latent image on the photosensitive body 101Y. As a result of this adhesion, a Y toner image is formed on the photosensitive body 101Y. In the developing unit 105Y, the Y developing agent in which the Y toner has been consumed by development is returned to the inside of the casing by the rotation of the developing roll 151Y.

A partition wall is disposed between the two conveying screws 155Y. A first supply part 153Y which accommodates the developing roll 151Y, the conveying screw 155Y on the right side of the figure and the like, and a second supply part 154Y which accommodates the conveying screw 155Y on the left side of the figure, are separated by this partition wall inside the casing. The conveying screw 155Y on the right side of the figure is rotationally driven by driving means not shown in the figures, so that the Y developing agent inside the first supply part 153Y is supplied to the developing roll 151Y while being conveyed into the depth of the figure from the foreground side of the figure. The Y developing agent that is conveyed to the vicinity of the end part of the first supply part 153Y by the conveying screw 155Y on the right side of the figure passes through an opening part (not shown in the figures) formed in the abovementioned partition wall, and advances into the second supply part 154Y. Inside the second supply part 154Y, the conveying screw 155Y on the left side of the figure is rotationally driven by driving means not shown in the figures, so that the Y developing agent that is fed from the first supply part 153Y is conveyed in the opposite direction from that of the conveying screw 155Y on the right side of the figure. The Y developing agent that is conveyed to the vicinity of the end part of the second supply part 154Y by the conveying screw 155Y on the left side of the figure passes through another opening part (not shown in the figures) formed in the abovementioned partition wall, and returns to the interior of the first supply part 153Y.

The abovementioned T sensor 156Y which comprises a magnetic permeability sensor is disposed on the bottom wall of the second supply part 154Y, and outputs a voltage having a value which corresponds to the magnetic permeability of the Y developing agent that passes over the T sensor 156Y. The magnetic permeability of a two-component developing agent that contains a toner and a magnetic carrier shows a good correlation with the toner concentration; accordingly, the T sensor 156Y outputs a voltage with a value that corresponds to the Y toner concentration. The value of this output voltage is sent to a control part not shown in the figures. This control part comprises a RAM that stores a Y Vtref value which is the target value of the output voltage from the T sensor 156Y. Data including an M Vtref value, C Vtref value and K Vtref value, which are the target values of the output voltages from the T sensors (not shown in the figures) mounted on the other developing units, is also stored in this RAM. The Y Vtref value is used for the driving control of the Y toner conveying unit (described later). In concrete terms, the abovementioned control part causes the Y toner to be replenished inside the second supply part 154Y by controlling the driving of the Y toner conveying unit (not shown in the figures) so that the value of the output voltage from the T sensor 156Y approaches the Y Vtref value. The driving of the Y toner conveying unit (not shown in the figures) is controlled so that the Y toner is replenished inside the second supply part 154Y. As a result of this replenishment, the concentration of the Y toner in the Y developing agent inside the developing unit 105Y is maintained in a specified range. Similar replenishment control using M, C and K toner conveying units is also performed for the developing units of the other process units.

In FIG. 14 shown above, an optical writing unit 107 is disposed beneath the process units 106Y, 106M, 106C, and 106K (with respect to the figures). The optical writing unit 107 constituting latent image forming means scans the respective photosensitive bodies 101Y, 101M, 101C and 101K in the process units 106Y, 106M, 106C and 106K by means of laser light L that is emitted on the basis of image information. As a result of this scanning, Y, M, C and K electrostatic latent images are formed on the photosensitive bodies 101Y, 101M, 101C and 101K. Furthermore, the optical writing unit 107 illuminates the photosensitive bodies 101Y, 101M, 101C, 101K via a plurality of optical lenses or mirrors while deflecting laser light (L) emitted from a light source in the main scan direction by reflecting this light from a polygonal mirror 107*a* that is rotationally driven by a motor.

Paper accommodating means comprising a paper supply cassette 126, a paper supply roller 127 that is built into the paper supply cassette 126 and the like is disposed beneath the optical writing unit 107 (with respect to the figures). A plurality of sheets of transfer paper P comprising sheet-form recording bodies are stacked and accommodated in this paper supply cassette 126, and the paper supply roller 127 is caused to contact the uppermost sheet of the transfer paper P. If the paper supply roller 127 is caused to rotate in the counterclockwise direction (with respect to the figures) by driving means not shown in the figures, the uppermost sheet of the transfer paper P is fed out toward a paper supply path 170.

A resist roller pair 128 is disposed in the vicinity of the terminus of this paper supply path 170. Both rollers of the resist roller pair 128 are caused to rotate so as to clamp the transfer paper P; however, the rollers are immediately stopped temporarily after clamping the transfer paper P. Then, the transfer paper P is fed out toward secondary transfer nips at an appropriate timing.

A transfer unit 115 comprising an endless moving body in which an intermediate transfer belt 108 that constitutes an intermediate transfer body is caused to move endlessly under tension is disposed above the process units 106Y, 106M, 106C and 106K (with respect to the figures). In addition to the intermediate transfer belt 108, this transfer unit 115 comprises a secondary bias transfer roller 119, a cleaning unit 110 and the like. Furthermore, this transfer unit 115 also comprises four primary transfer bias rollers 109Y, 109M, 109C and 109K, a secondary transfer backup roller 112, a cleaning backup roller 113, a tension roller 114 and the like. The intermediate transfer belt 108 is caused to move endlessly in the counterclockwise direction (with respect to the figures) by the rotational driving of at least one of these seven rollers while being mounted under tension on these seven rollers. The primary transfer bias rollers 109Y, 109M, 109C and 109K thus clamp the endlessly moving intermediate transfer belt 108 between themselves and the photosensitive bodies 101Y, 101M, 101C and 101K, forming primary transfer nips. These rollers constitute a system which applies a transfer bias of the opposite polarity from that of the toner (e.g., plus) to the back surface of the intermediate transfer belt 108 (i.e., the inner circumferential surface of the loop). The rollers other than the primary transfer bias rollers 109Y, 109M, 109C and 109K are all electrically grounded. In the process of the intermediate transfer belt 108 successively passing through the primary transfer nips for Y, M, C and K as the belt moves in an endless manner, Y, M, C and K toner images are superimposed and subjected to primary transfer onto the intermediate transfer belt 108. As a result, a toner image with four colors superimposed (hereafter referred to as a "four-color toner image") is formed on the intermediate transfer belt 108.

The abovementioned secondary transfer backup roller 112 forms a secondary transfer nip in which the intermediate transfer belt 108 is clamped between this backup roller 112 and the secondary transfer roller 119. The four-color toner image constituting a visible image that is formed on the intermediate transfer belt 108 is transferred onto the transfer paper P by this secondary transfer nip. Then, together with the white color of the transfer paper P, a full color toner image is formed. The residual toner following transfer that was not transferred onto the transfer paper P adheres to the intermediate transfer belt 108 that has passed through the secondary transfer nip. This is cleaned by the cleaning unit 110. The transfer paper P onto which the four-color toner image has been secondarily transferred at one time by the secondary transfer nip is fed into a fixing unit 120 via a post-transfer conveying path 171.

The fixing unit 120 forms a fixing nip by means of a fixing roller 120*a* which has a heating source such as a halogen lamp or the like inside, and a pressing roller 120*b* which rotates while contacting the fixing roller 120*a* at a specified pressure. The transfer paper P that is fed into the fixing unit 120 is clamped by the fixing nip so that the surface carrying the unfixed toner image is caused to adhere tightly to the fixing roller 120*a*. Then, the toner in the toner image is softened by the effects of heat and pressure so that the full color image is fixed.

After leaving the fixing unit 120, the transfer paper P on which the full color image has been fixed inside the fixing unit 120 reaches a branch point between a paper discharge path 172 and a pre-reversal conveying path 173. A first switching claw 175 is disposed at this branch point so that this claw 175 is free to swing, and the path of advance of the transfer paper P is switched by the swinging of this claw 175. In concrete terms, as a result of the tip end of the claw 175 swinging in a direction that approaches the pre-reversal conveying path 173, the path of advance of the transfer paper P is oriented in a direction that faces the paper discharge path 172. On the other hand, if the tip end of the claw 175 is moved away from the pre-reversal conveying path 173, the path of advance of the transfer paper P is oriented in a direction that faces the pre-reversal conveying path 173.

In cases where a path of advance that is directed toward the paper discharge path 172 is selected by means of the first switching claw 175, the transfer paper P is discharged to the outside of the apparatus from the paper discharge path 172 via a paper discharge roller pair 100, and is stacked on a stacker 150*a* that is disposed on the upper surface of the printer housing. On the other hand, in cases where a path of advance that is directed toward the pre-reversal conveying path 173 is selected by means of the first switching claw 175, the transfer paper P advances into the nip of an inversion roller pair 121 via the pre-reversal conveying part 173. The inversion roller pair 121 conveys the transfer paper P clamped between the rollers toward the stacking part 150*a*; however, immediately before the rear end of the transfer paper P is caused to advance into the nip, the rollers are caused to rotate in the reverse direction. As a result of this reverse rotation, the transfer paper P is conveyed in the reverse direction from the direction in which the paper has been conveyed up to this point, so that the rear end of the transfer paper P advances into a reverse conveying path 174.

The reverse conveying path 174 has a shape that extends while bending downward from above in the vertical direction, and has a first conveying roller pair 122, a second reverse conveying roller pair 123 and a third reverse conveying roller pair 124 within this pathway. The transfer paper P is conveyed while successively passing through the nips of these roller pairs, so that this paper is turned upside down. After being turned upside down, the transfer paper P is returned to the abovementioned paper supply path 170, and again reaches the secondary transfer nip. Then, in the current case, the paper advances into the secondary transfer nip while the non-image-carrying surface is caused to adhere tightly to the intermediate transfer belt 108, so that a second four-color toner image on the intermediate transfer belt 108 is secondarily transferred all at one time to this non-image-carrying surface. Subsequently, the transfer paper P passes through the post-reversal conveying path 171, the fixing unit 120, the paper discharge path 172 and the paper discharge roller pair 100, and is stacked on the stacking part 150*a* located outside the apparatus. As a result of such reverse conveying, full color images are formed on both sides of the transfer paper P.

A bottle supporting part 131 is disposed between the abovementioned transfer unit 115 and the stacking part 150*a* that is located above this transfer unit 115. Toner bottles 132Y, 132M, 132C and 132K constituting toner accommodating parts that accommodate the Y, M, C and K toners are mounted in this bottle supporting part 131. The toner bottles 132Y, 132M, 132C and 132K are disposed so that these bottles are lined up at mutual angles that are slightly inclined from the horizontal, and the installation positions are successively higher in the order Y, M, C, K. The Y, M, C and K toners inside the toner bottles 132Y, 132M, 132C and 132K are appropriately replenished in the developing units of the process units 106Y, 106M, 106C and 106K. These toner bottles 132Y, 132M, 132C and 132K can be attached to or detached from the printer main body independently from the process units 106Y, 106M, 106C and 106K.

Figure 16:
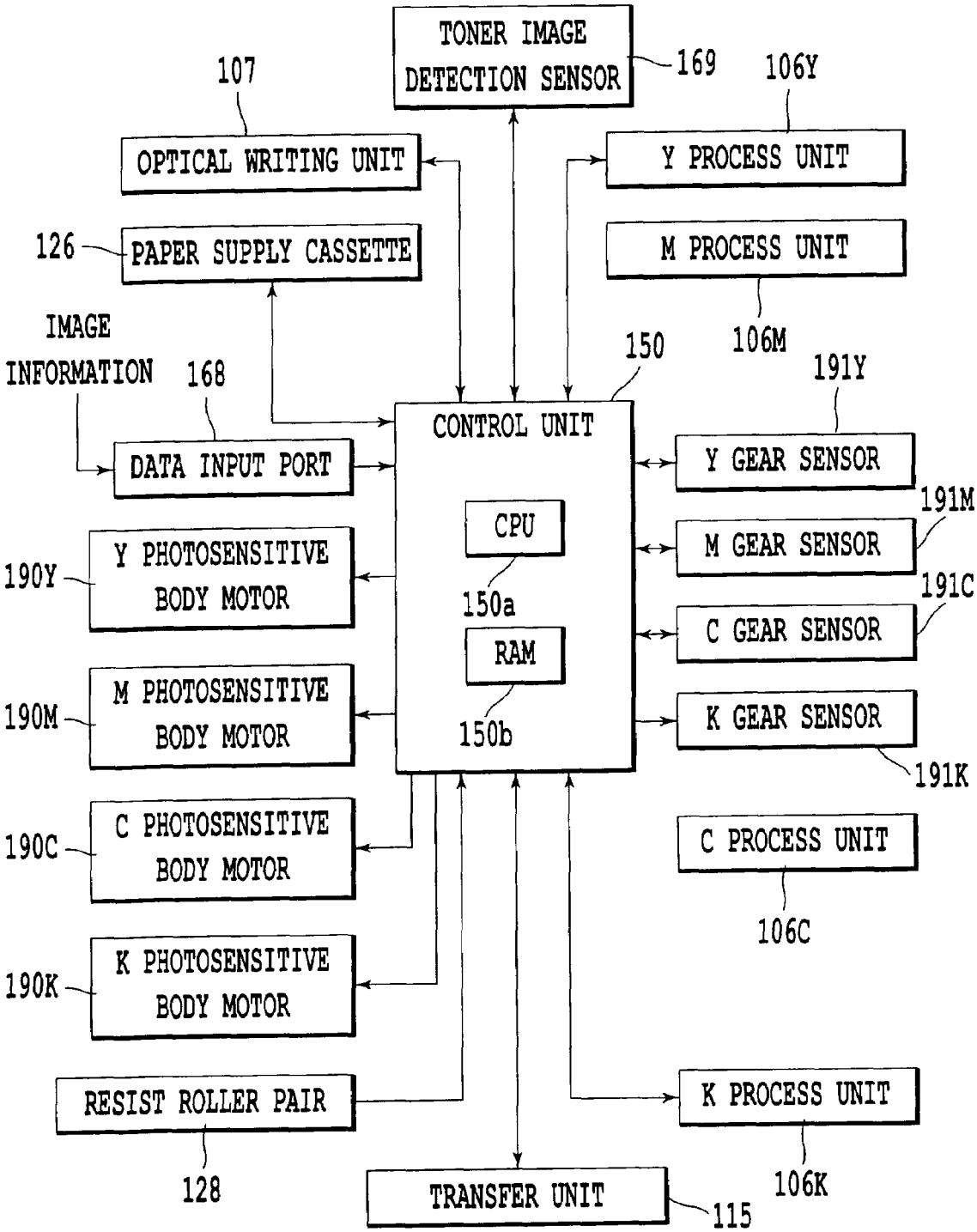
FIG. 16 is a block diagram showing the construction of a portion of the control system of the same printer.

FIG. 16 is a block diagram showing a portion of the control system of this printer. In this figure, the process units 106Y, 106M, 106C and 106K, optical writing unit 107, paper supply cassette 126, resist roller pair 128, transfer unit 115, toner image detection sensor 169, data input port 168 and the like are connected to a printer (control part) 150. Furthermore, Y, M, C and K photosensitive body motors 190Y, 190M, 190C and 190K, Y, M, C and K gear sensors 191Y, 191M, 191C and 191K and the like are also connected to the control part 150. The toner image detection sensor 169 detects a reference toner image (described later) that is transferred onto the intermediate transfer belt 108. Furthermore, the Y, M, C and K photosensitive body motors 190Y, 190M, 190C and 190K rotationally drive the Y, M, C and K photosensitive bodies 101Y, 101M, 101C and 101K. Moreover, the Y, M, C and K gear sensors 191Y, 191M, 191C and 191K detect scale marks that are applied to the gears fastened to the rotating shaft members of the Y, M, C and K photosensitive bodies 101Y, 101M, 101C and 101K.

The control part 150 comprises a CPU 150*a* that performs calculation processing, and a RAM 150*b* that stores data. Furthermore, this control part 150 performs speed setting processing at a specified timing. In this speed setting processing, the photosensitive bodies 101Y, 101M, 101C and 101K shown in FIG. 14 are first uniformly charged while being caused to rotate. Then, Y, M, C and K reference toner images consisting of specified pixel patterns are respectively formed on the four photosensitive bodies 101Y, 101M, 101C and 101K by respectively scanning electrostatic latent images used to form these reference toner images with laser light. Furthermore, the Y, M, C and K reference toner images obtained on the photosensitive bodies 101Y, 101M, 101C and 101K by developing these images are respectively transferred onto the intermediate transfer belt 108.

Next, the characteristic construction of this printer will be described.

Figure 17:
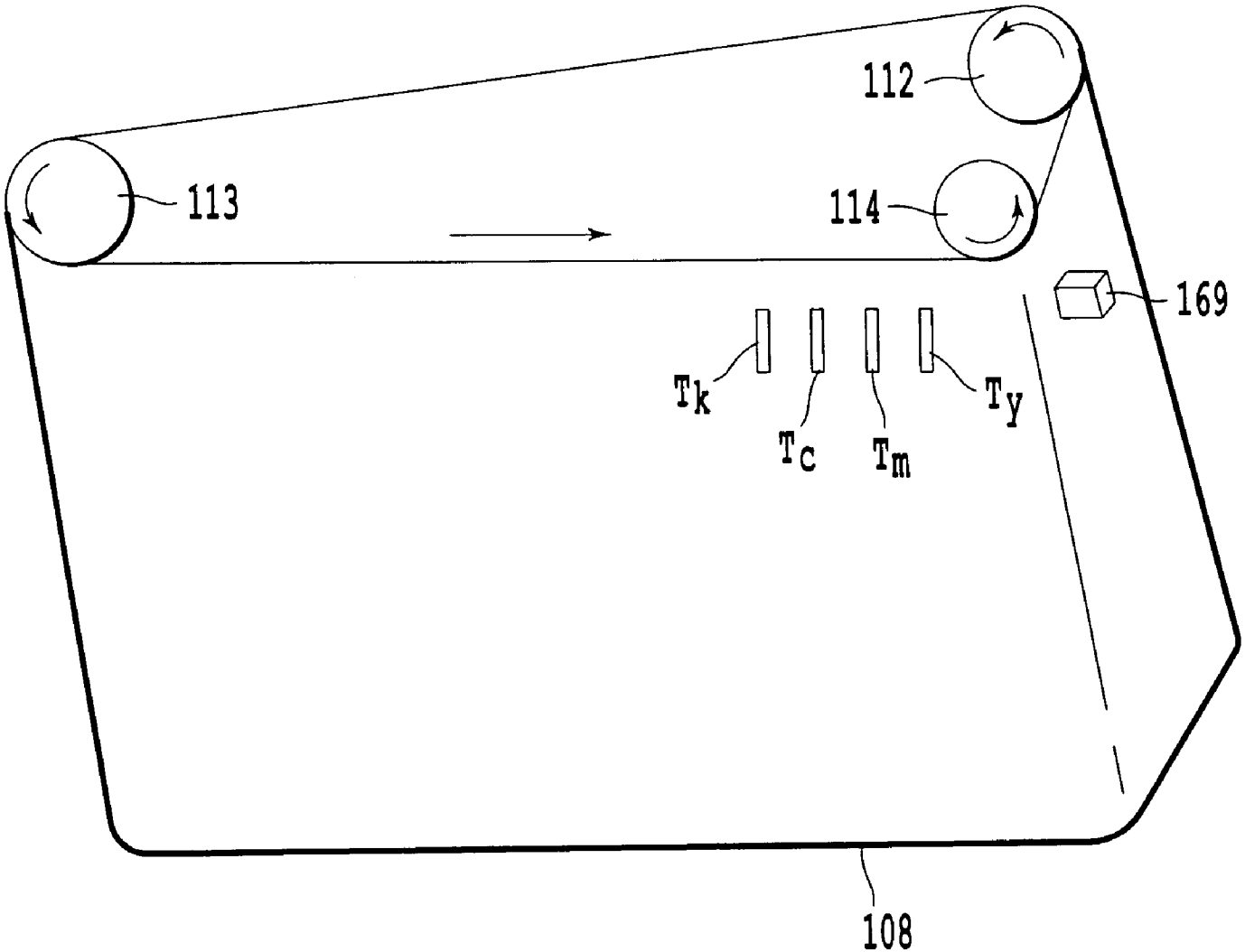
FIG. 17 is a perspective view showing the schematic construction of the transfer unit of the same printer.

As is shown in FIG. 17, the optical scanning that is used to form reference toner images on the photosensitive bodies 101Y, 101M, 101C and 101K is initiated at a timing which is such that the Y, M, C and K reference toner images are respectively transferred onto the intermediate transfer belt 108 at equal intervals in the belt movement direction. The Y, M, C and K reference toner images Ty, Tm, Tc and Tk that are transferred onto the intermediate transfer belt 108 so that these images are lined up at equal intervals are successively detected by a toner image detection sensor 169 consisting of a reflective type photo-sensor. Under ordinary circumstances, the spacing of the Y, M, C and K reference toner images detected by the toner image detection sensor 169 is uniform. However, if the light path of the laser light inside the optical writing unit 107 fluctuates due to temperature variations, or if the process units 106Y, 106M, 106C or 106K are loose, the optical writing positions with respect to the photosensitive bodies 101Y, 101M, 101C and 101K will show a mutual shift in relative terms, so that the Y, M, C and K reference toner images are no longer formed at uniform intervals. Then, the detection spacing at which the Y, M, C and K reference toner images are detected by the toner image detection sensor 169 becomes non-uniform. In such a state, an overlap deviation is generated in the respective color toner images at the time of print-out. Accordingly, the control part 150 individually sets the driving speeds of the Y, M, C and K photosensitive body motors 190Y, 190M, 190C and 190K on the basis of the variation in the spacing of the Y, M, C and K reference toner images detected by the toner image detection sensor 169. Then, by means of this setting, the respective photosensitive bodies are endowed with a difference in linear velocity at the time of the printing operation (if necessary), so that the respective color toner images are accurately superimposed by the respective primary transfer nips.

Figure 18A:
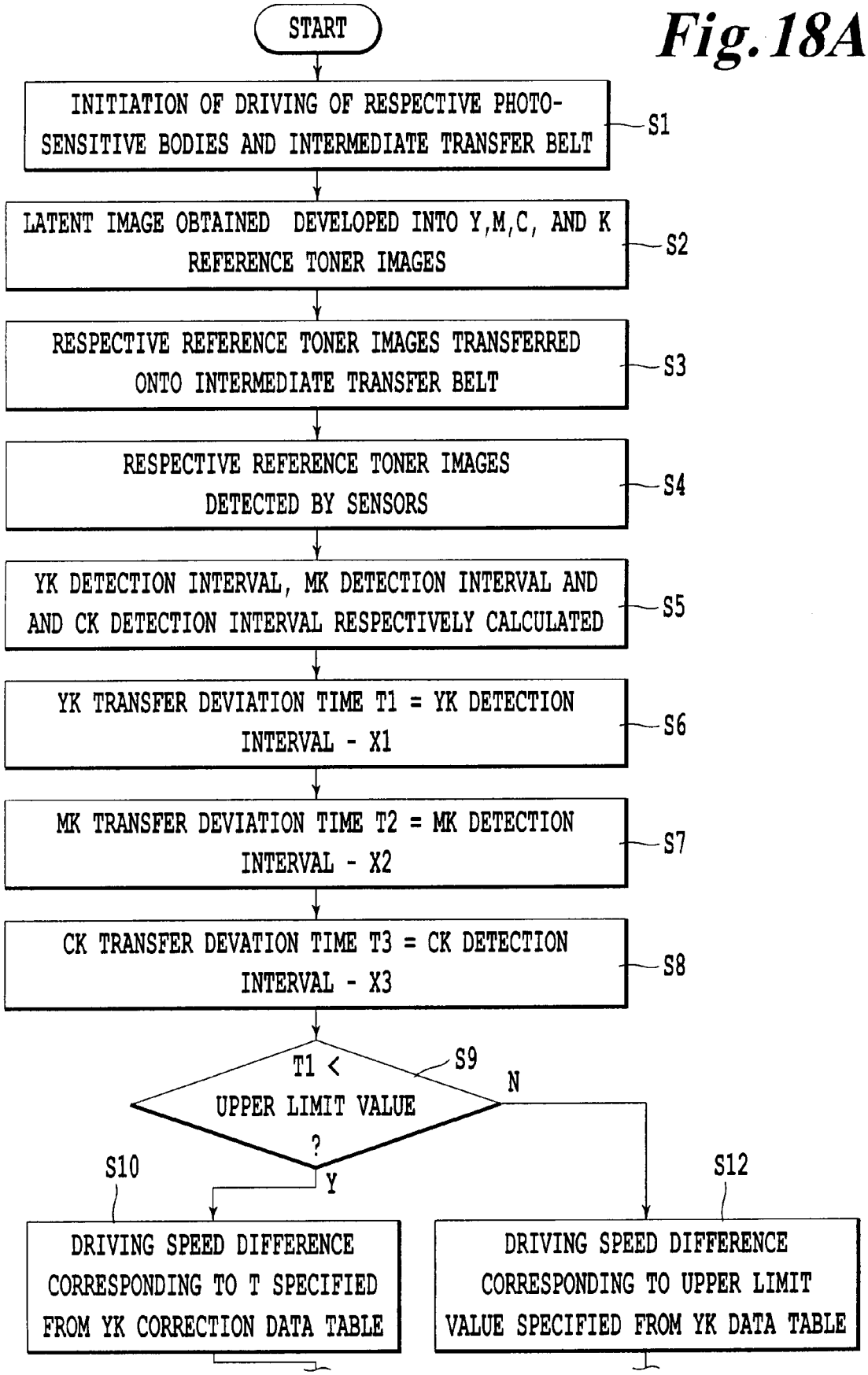
FIGS. 18A and 18B illustrate a flow chart showing one example of the control flow of the speed setting processing that is performed by the control system of the same printer.
Figure 18B:
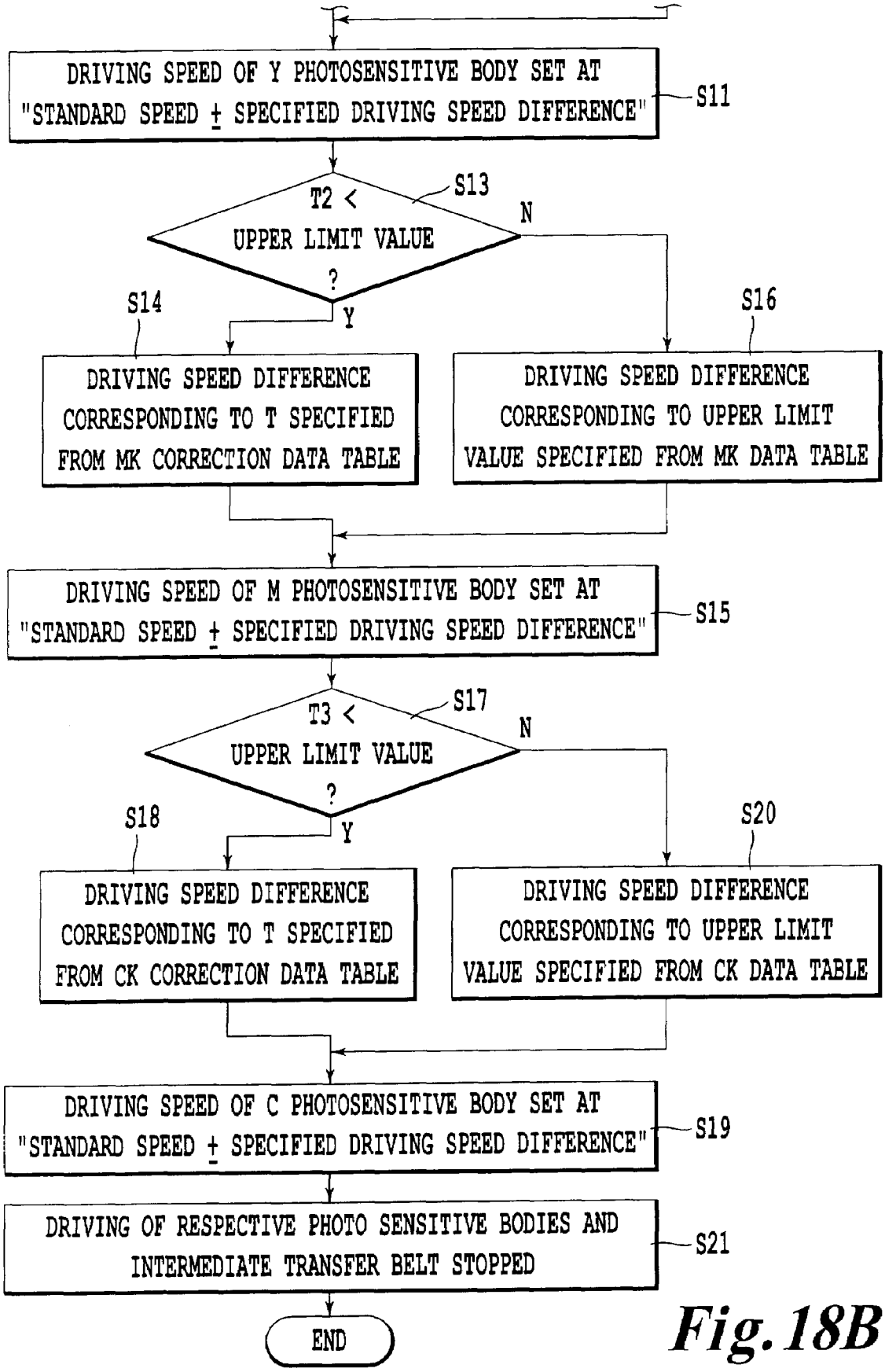

FIGS. 18A 18B illustrate a flow chart showing one example of the control flow of the speed setting processing that is performed by the control part 150. This speed setting processing is performed immediately after the main power supply of the printer (not shown in the figures) is switched on, or whenever a specified time has elapsed in a state in which the main power supply is switched on. In this speed setting processing, after the driving of the respective photosensitive bodies and intermediate transfer belt has first been initiated, optical writing that is used to form Y, M, C and K reference toner images is performed for the respective photosensitive bodies (step S1: hereafter, step is abbreviated as "S"). The electrostatic latent images obtained by this optical writing are developed by the respective corresponding developing units, so that Y, M, C and K reference toner images are obtained (S2); then, these respective images are transferred onto the intermediate transfer belt (S3). The Y, M, C and K reference toner images transferred onto the intermediate transfer belt are successively detected by the toner image detection sensor (S4). In the process of this detection, the control part respectively measures the YK detection interval which is the time interval extending from the point in time at which the Y reference toner image is detected to the point in time at which the K reference toner image is detected, and the MK detection interval which is the time interval extending from the point in time at which M reference toner image is detected to the point in time at which the K reference toner image is detected (S5). Furthermore, the control part also measures the CK detection interval which is the time interval extending from the point in time at which the C reference toner image is detected to the point in time at which the K reference toner image is detected (S5). Respective specified values X1, X2 and X3 are subtracted from the YK detection interval, MK detection interval and CK detection interval, so that the YK transfer deviation time T1, CK transfer deviation time T2 and MK transfer deviation time T3 are respectively calculated (S6, S7, S8). In cases where these transfer deviation times are respectively "zero", there is no transfer deviation in the K reference toner image or in the Y, M or C reference transfer images.

A correction data table in which respective transfer deviation time values and appropriate driving speed difference correction values confirmed by tests performed beforehand are associated for the respective transfer deviation times T1, T2 and T3 is stored in the abovementioned RAM of the control part. These driving speed difference correction values indicate that the Y, M and C toner images can be exactly superimposed on the K toner image by introducing driving speed differences equal to these correction values between the K photosensitive body and the Y, M and C photosensitive bodies. When the control part calculates the respective transfer deviation times T1, T2 and T3, the control part next judges whether or not the transfer deviation time T1 is less than a specified upper limit value (S9). This means that a judgment is made as to whether or not the driving speed difference between the Y photosensitive body (101Y) and K photosensitive body (101K) which is to be set in accordance with the deviation transfer time T1 is less than a specified upper limit value. Furthermore, in cases where this difference is less than the abovementioned upper limit value (Y in S9), the driving speed difference corresponding to transfer deviation time T1 is specified from the YK correction data table (S10), and the driving speed of the Y photosensitive body is set at a value that is correspondingly increased or decreased from the reference speed (S11). On the other hand, in cases where this difference exceeds the abovementioned upper limit value (N in S9), the driving speed difference corresponding to the upper limit value is specified from the YK data table (S12), and the driving speed of the Y photosensitive body is set at a value that is correspondingly increased or decreased from the reference speed (S11). In this way, the driving speed difference between the Y photosensitive body and K photosensitive body is kept at a value that is equal to or less than the abovementioned upper limit value. Processing which is the same as that of the abovementioned S11 and S12 is also performed for the transfer deviation times T2 and T3 (S13 through S20), and the driving times of the M photosensitive body and C photosensitive body are set at values that are increased or decreased by an amount corresponding to the respective specified driving speed differences. Then, at the time of the next printing job, the K photosensitive body is driven at the specified reference speed, and the Y, M and C photosensitive bodies are driven at the driving speeds set by the speed setting processing shown in the respective figures, so that toner images of the respective colors are formed.

Figure 19:
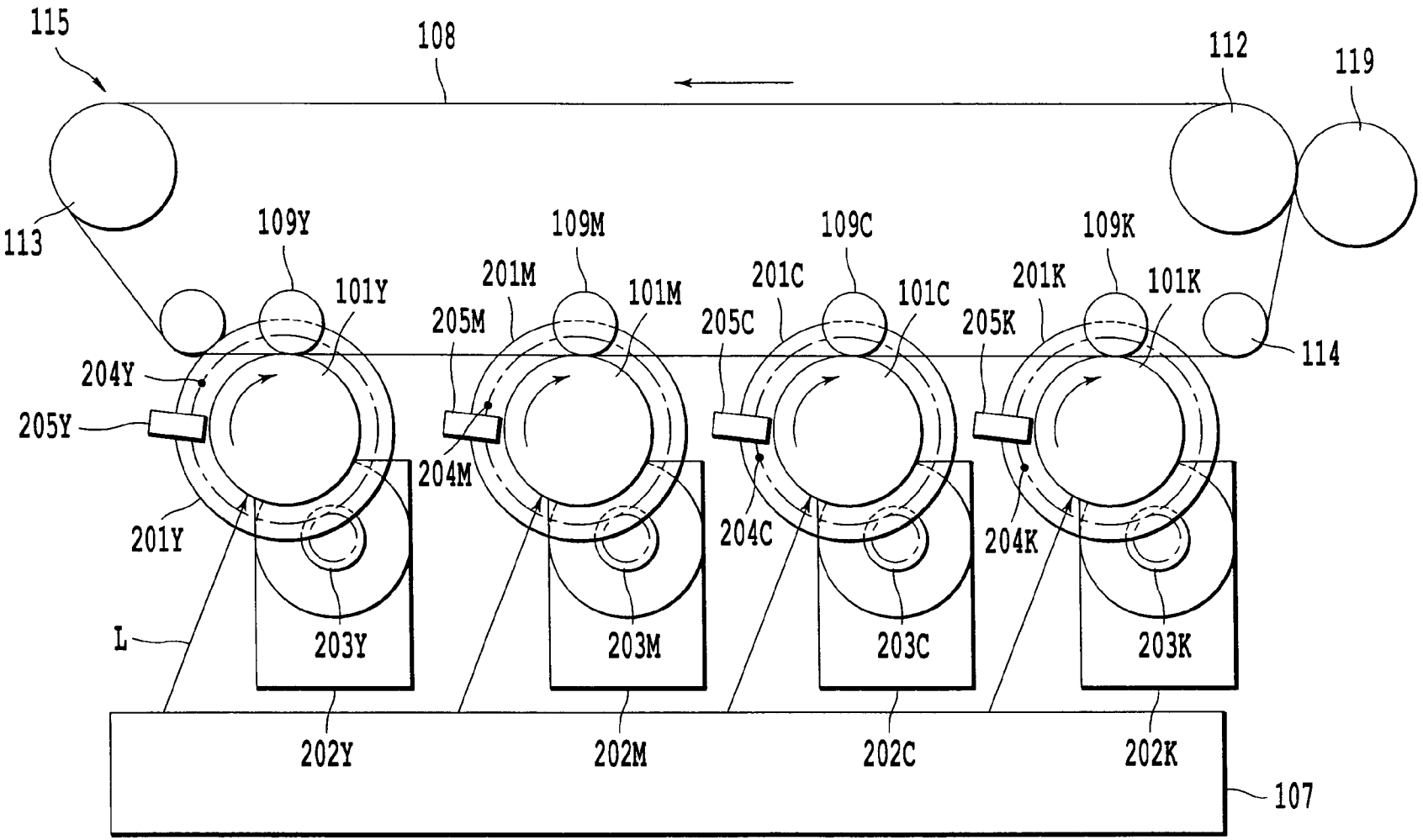
FIG. 19 is a diagram showing the four photosensitive bodies, the transfer unit and the surrounding construction.

FIG. 19 shows the four photosensitive bodies 101Y, 101M, 101C and 101K, the transfer unit 115, and the surrounding construction. In this figure, the photosensitive bodies 101Y, 101M, 101C and 101K are respectively supported by bearings not shown in the figures, so that these photosensitive bodies 101Y, 101M, 101C and 101K can rotate about their rotating shafts. Photosensitive body gears 201Y, 201M, 201C and 201K which are much larger in diameter than the photosensitive bodies 101Y, 102M, 101C and 101K are fastened to the respective rotating shafts at one end of each of these rotating shafts. A K prime moving gear 203K which is fastened to the motor shaft of the K photosensitive body motor 202K engages with the K photosensitive body gear 201K. Furthermore, a C prime moving gear 203C which is fastened to the motor shaft of the C photosensitive body motor 202C engages with the C photosensitive body gear 201C. Moreover, an M prime moving gear 203M which is fastened to the motor shaft of the M photosensitive body motor 202M engages with the M photosensitive body gear 201M. Furthermore, a Y prime moving gear 203Y which is fastened to the motor shaft of the Y photosensitive body motor 202Y engages with the Y photosensitive body gear 201Y.

Scale marks 204Y, 204M, 204C and 204K consisting of a light-reflecting material are applied to the respective photosensitive body gears 201Y, 201M, 201C and 201K in the respective locations of maximum eccentricity; these scale marks 204Y, 204M, 204C and 204K are detected at a specified rotational angle by gear sensors 205Y, 205M, 205C and 205K consisting of reflective type photo-sensors.

In the case of monochromatic printing for which demand is higher than color printing, the system is devised so that only the K photosensitive body 101K is driven; accordingly, consumption of the photosensitive bodies 101Y, 101M and 101C and motors 202Y, 202M and 202C is suppressed, and energy is saved. In this case, the transfer unit 115 adopts an attitude which is such that the intermediate transfer belt 108 is caused to contact only the K photosensitive body 101K (among the four photosensitive bodies 101Y, 101M, 101C and 101K).

Thus, in the case of monochromatic printing, since only the K photosensitive body 101K is rotationally driven, the phases of the locations of maximum eccentricity of the K photosensitive body gear 201K and other photosensitive body gears 201Y, 201M and 201C subsequently show an inevitable difference even if these phases are once aligned. Accordingly, in the present printer, when the printing operation is completed, the respective photosensitive body motors 202Y, 202M, 202C and 202K are individually stopped on the basis of the detection results from the respective gear sensors 205Y, 205M, 205C and 205K, so that the rotational phases of the respective photosensitive body gears 201Y, 201M, 201C and 201K are aligned.

Next, a printer constituting a modification in which a more characteristic construction is added to the present printer will be described. Below, furthermore, unless otherwise specially noted, the basic construction of the printer of the present modification is the same as that of the printer of the second embodiment.

Figure 20:
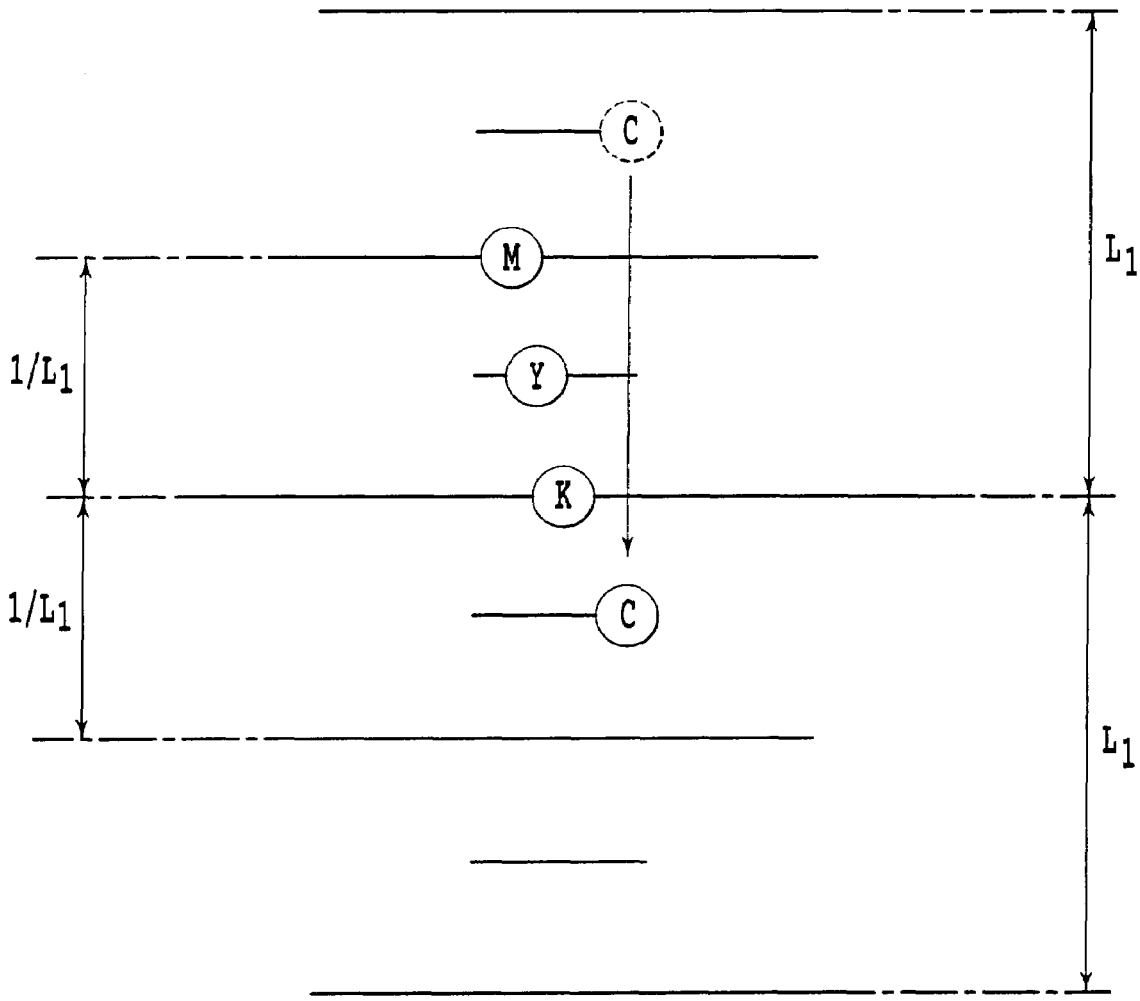
FIG. 20 is a model diagram which shows the relative positional relationship of the optical scanning starting positions in the sub-scan direction for the Y, M, C and K photosensitive bodies of the same printer.

FIG. 20 is a model diagram showing the relative positional relationship of the optical scanning initiation positions in the sub-scan direction for the photosensitive bodies 101Y, 101M, 101C and 101K. The alphabetic characters Y, M, C and K surrounded by circles in this figure respectively indicate the laser irradiation spots of the first dots for the photosensitive bodies 101Y, 101M, 101C and 101K. Furthermore, in the same figure, the character C surrounded by a dotted circle indicates the predicted laser irradiation position of the first dot for the C photosensitive body 101C, Moreover, at the same time, L1 indicates the length of one dot in the sub-scan direction. Furthermore, needless to say, L/1;2 indicates half of the length of L1. Moreover, in the present printer, as was described above, the driving speeds of the Y, M and C photosensitive bodies 101Y, 101M and 101C are respectively set using the K photosensitive body 101K, which is driven at a standard speed, as a reference.

In the same figure, if the laser spot irradiation position of the first dot for the C photosensitive body 101C is the position of C surrounded by a dotted circle, the C toner image and K toner image will show an overlap deviation that is L/1;2 or greater, i.e., half the size of one dot or greater, in the sub-scan direction. It is not possible simply to shift the laser light irradiation time by a corresponding amount in order to eliminate such a deviation in the sub-scan direction. The reason for this is as follows: namely, since the laser light moves in the main scan direction, if irradiation is initiated at a timing that is shifted even slightly from the planned irradiation initiation timing, optical writing corresponding to the end parts will be performed from points located further toward the center than the end parts in the main scan direction. In order to shift the irradiation initiation timing, it is necessary to shift this timing in units equal to at least one dot (one line). Here, the irradiation initiation timing or the C photosensitive body 101C is delayed from the initial planned timing by an amount equal to one dot. Accordingly, the optical writing initiation position for the C photosensitive body 101C is shifted from the position of C surrounded by a dotted circle to the position of C surrounded by a solid circle in the figures. Then, the overlap deviation between the C toner image and the K toner image is reduced to a length that is shorter than L/1;2. In other words, the overlap deviation is reduced.

By thus shifting the irradiation initiation timing, it is possible to keep the amount of overlap deviation to L/1;2 or less without creating a difference in linear velocity between the photosensitive bodies. In the relationship between the M toner image and K toner image and the relationship between the C toner image and the K toner image as well, it is similarly possible to keep the amount of overlap deviation to a value of L/1;2 or less without creating a difference in linear velocity between the photosensitive bodies.

Accordingly, in the abovementioned speed setting processing that is performed in the printer of the present modification, the following processing is performed on the basis of the detection timing of the respective reference toner images in cases where calculation results are obtained in which the overlap deviation with K is L/1;2 or greater (among the three colors Y, M and C). Specifically, as is shown in FIG. 20, a setting is first made in which the irradiation initiation timing is advanced or delayed by an amount equal to one dot with respect to the planned irradiation initiation timing. As a result, a setting is made in which the amount of overlap deviation that would otherwise have occurred with a length of L/1;2 or greater can be kept to a value of L/1;2 or less without varying the driving speeds of the photosensitive bodies.

However, even if such a setting is made, overlap deviation occurs at a length of L/1;2 or less. Accordingly, in the case of such overlap deviation with a length of L/1;2 or less, the setting of the driving speed of the Y, M or C photosensitive body 101Y, 101M or 101C is altered, so that a difference in linear velocity is created between this driving speed and the driving speed of the K photosensitive body 101K (i.e., the standard driving speed). Consequently, the upper limit value in S9, S13 and S17 in FIGS. 18A and 18B is smaller than one-half of one pixel.

In the case of such a construction, overlap deviation can be suppressed in the same manner as in cases where overlap deviation is suppressed by means of the linear velocity of the photosensitive bodies alone, while reducing the difference in linear velocity compared to cases in which overlap deviation of L/1;2 or greater is suppressed by means of the difference in linear velocity between the photosensitive bodies alone.

Furthermore, the present printer is not a printer in which the Y, M and C photosensitive bodies 101Y, 101M and 101C (hereafter referred to as "color photosensitive bodies") are driven at driving speeds respectively set in the previous speed setting processing when the abovementioned speed setting processing is performed; like the K photosensitive body 101K, these photosensitive bodies are also driven at a standard speed. In such a construction, the complication of calculation processing and drop in precision that results from the accumulation of correction values of the driving speeds attributable to the fact that the respective color photosensitive bodies are driven at driving speeds set in the previous speed setting processing can be avoided.

In regard to the speed setting processing, as was described above, this processing is performed each time that a specified period of time has elapsed in a state in which the main power supply (not shown in the figures) is switched on (e.g., each time that the print-out of a specified number of sheets is performed). Then, the timing at which speed setting processing is to be performed may arrive during a continuous printing operation constituting a continuous image formation operation in which images are continuously printed out on a plurality of sheets of transfer paper P. In cases where such a timing arrives, speed setting processing may be performed at a timing between the printing operation corresponding to the preceding sheet of transfer paper P and the printing operation corresponding to the following sheet of transfer paper P (hereafter referred to as "inter-sheet timing"); in such a case, however, if a long time is required for speed setting processing, the waiting time of the user is extended. In the present printer, therefore, in cases where speed setting processing is performed at an inter-sheet timing, the preceding printing operation, speed setting processing operation and following printing operation are all performed continuously without being stopped. In such a construction, the user waiting time can be shortened compared to cases in which any of the printing operations is stopped.

Even in the case of printers that have just been manufactured, the relationships of the abovementioned deviation correction data table cannot be obtained if the detection sensitivity of the abovementioned toner image detection sensors, the driving load on the respective photosensitive bodies or the like varies greatly from the standard value because of differences in the manufacturing lot or the like. Furthermore, as a result of this, a situation may arise in which the overlap deviation is not favorably reduced when speed setting processing is performed in an ordinary manner. Generally, however, in such cases, the amount of overlap deviation following speed setting processing is almost always a constant value. In such cases, therefore, the present printer is devised so that a correction is made by adding a specified numerical value to the abovementioned YK transfer deviation time T1, CK transfer deviation time T2 or MK transfer deviation time T3 constituting the amount of positional deviation. Adding a specified numerical value to these deviation times is the same as adding a specified numerical value to the driving speeds. In such a construction, even if there is a manufacturing lot error in the detection sensitivity of the toner image detection sensors or the driving load that is applied to the respective photosensitive bodies, the overlap deviation of the respective color toner images can be favorably suppressed. Furthermore, the concrete method used to add such a specified numerical value is as follows: specifically, in the flow chart of FIGS. 18A and 18B shown above, a specified numerical value is added to the YK transfer deviation time T1, CK transfer deviation time T2 or MK transfer deviation time T3 following the processing of S8.

Furthermore, the present printer is devised so that the printer can be switched between operation in a high-speed printing mode in which the printing speed is given a higher priority than image quality, and operation in an image quality priority mode in which the printing speed is conversely slower than in the high-speed printing mode, and a higher image quality is achieved. Furthermore, the system is devised so that different values are used in the two modes as the upper limit value shown above in S9, S13 an S17 in FIGS. 18A and 18B. In such a construction, even in cases where the system is operated by switching between two or more modes with mutually different driving speeds, the overlap deviation of the respective color toner images can be kept to a specified value or less in the respective modes. Naturally, furthermore, the abovementioned deviation correction data table consists of mutually different tables for the respective modes.

Thus, the second embodiment of the present invention and the modifications of this embodiment offer the following merits.

(1) The driving speeds of a plurality of image carriers are individually set on the basis of the amount of relative positional deviation of visible images that are respectively transferred from these respective image carriers onto the surface of an endless moving body such as an intermediate transfer belt, paper conveyor belt or the like. Then, as a result of such a setting, overlap deviation caused by the relative deviation of the formation positions of the visible images on the plurality of image carriers can be suppressed by endowing the respective image carriers with a difference in linear velocity corresponding to the amount of positional deviation.

(2) In this case, furthermore, the rotational speed differences among a plurality of gears individually corresponding to respective latent image carriers can be kept within a specified range by keeping the driving speed differences among the respective image carriers to a specified upper limit value or less. As a result, skewing of the rotational phase caused by differences in the driving speeds of the respective gears can be reduced, so that a condition of conspicuous overlap deviation caused by rotational phase deviation of the gears in a continuous image formation operation can be suppressed.

Various modifications will become possible for those skilled in the art after receiving the teachings of the present disclosure without departing from the scope thereof.

What is claimed is:

1. A printer engine comprising:

a plurality of photosensitive bodies which are rotationally driven, and which have toner images formed on the outer circumferential surfaces thereof;

an endless belt which is disposed facing the outer circumferential surfaces of said photosensitive bodies, and which runs while carrying toner images that have been transferred from said photosensitive bodies, or while holding a recording medium onto which the toner images on said photosensitive bodies are transferred;

means for forming detection pattern toner images on said photosensitive bodies which are used to detect an amount of positional deviation of transfer positions of the toner images of respective colors when the toner images formed on said photosensitive bodies are superimposed and transferred onto said endless belt or the recording medium held on said endless belt;

means for transferring the detection pattern toner images formed on said respective photosensitive bodies onto said endless belt or the recording medium held on said endless belt;

means for detecting the detection pattern toner images that have been transferred onto said endless belt or the recording medium held on said endless belt;

means for judging the amount of positional deviation in the transfer positions of the detection pattern toner images of the respective colors on the basis of the detection results of said means for detecting the detection pattern toner images; and means for adjusting the rpm of driving parts that drive said photosensitive bodies on the basis of the judgment results of said means for judging the amount of positional deviation in the transfer positions so that the linear velocities of said photosensitive bodies are caused to agree with each other.

2. The printer engine as claimed in claim 1, wherein said driving parts are individually connected to said plurality of photosensitive bodies.

3. The printer engine as claimed in claim 2, further comprising:

a plurality of gears which are connected to said photosensitive bodies, and which transmit a rotational driving force to said respective photosensitive bodies;

detected parts which are disposed on said respective gears;

a plurality of sensors which detect said detected parts;

means for detecting deviation in rotational phase between said gears on the basis of the detection results obtained by said sensors;

means for judging that the rotational phase between said gears detected by said means for detecting the deviation in the rotational phase has been shifted by a fixed angle; and means for driving said driving parts so that said gears are caused to rotate to a position where the deviation in the rotational phase between said gears is eliminated in cases where it is judged by said means that the rotational phase between said gears has been shifted by the fixed angle.

4. The printer engine as claimed in claim 1, wherein said printer engine has a photosensitive body on which a black toner image is formed, a photosensitive body on which a yellow toner image is formed, a photosensitive body on which a cyan toner image is formed and a photosensitive body on which a magenta toner image is formed as said photosensitive bodies, said photosensitive body on which the yellow toner image is formed, said photosensitive body on which the cyan toner image is formed and said photosensitive body on which the magenta toner image is formed are connected to a common driving part among said driving parts, and said photosensitive body on which the black toner image is formed is connected to another driving part among said driving parts.

5. The printer engine as claimed in claim 4, further comprising:

a gear which is connected to said photosensitive body on which the black toner image is formed, and which transmits a rotational driving force to the photosensitive body on which the black toner image is formed;

a gear which is rotationally driven by said common driving part, and is connected to one of said photosensitive bodies on which said yellow, cyan and magenta toner images are formed, and which transmits a rotational driving force to the photosensitive bodies on which said yellow, cyan and magenta toner images are formed;

detected parts which are disposed on said respective gears;

two sensors that detect said detected parts;

means for detecting deviation in rotational phase between said gears on the basis of the detection results obtained by said sensors;

means for judging that the rotational phase between said gears detected by said means for detecting the deviation in the rotational phase has shifted by a fixed angle; and means for driving said driving parts so that said gears are caused to rotate to a position where the deviation in the rotational phase between said gears is eliminated in cases where it is judged by said means that the rotational phase between said gears has shifted by the fixed angle.

6. The printer engine as claimed in claim 1, wherein rotating shafts that are rotationally driven about the center lines thereof are provided, said photosensitive bodies are removably attached to the rotating shafts, engaging parts that rotate as a unit with the rotating shafts are disposed on said rotating shafts, and engaging parts that are removably engaged with said engaging parts by sliding said photosensitive bodies along the center lines of said rotating shafts are disposed on said photosensitive bodies.

7. The printer engine as claimed in claim 1, further comprising a process cartridge in which at least said photosensitive bodies and charging means that uniformly charge the outer circumferential surfaces of said photosensitive bodies are accommodated and unitized inside a case, and which is mounted inside a main body case in a detachable manner.

8. The printer engine as claimed in claim 1, wherein said endless belt comprises an intermediate transfer belt.

9. The printer engine as claimed in claim 1, wherein said endless belt comprises a transfer conveyor belt.

10. A color image forming device comprising:

a printer engine;

a recording medium accommodating part which accommodates a recording medium that is supplied to said printer engine;

a fixing device which fixes color toner images that are transferred onto said recording medium; and a recording medium discharge part to which the recording medium on which a toner image has been fixed is discharged, said printer engine comprising a plurality of photosensitive bodies which are rotationally driven, and which have toner images formed on the outer circumferential surfaces thereof, an endless belt which is disposed facing the outer circumferential surfaces of said photosensitive bodies, and which runs while carrying toner images that have been transferred from said photosensitive bodies, or while holding a recording medium onto which the toner images on said photosensitive bodies are transferred, means for forming detection pattern toner images on said photosensitive bodies which are used to detect an amount of positional deviation of transfer positions of the toner images of respective colors when the toner images formed on said photosensitive bodies are superimposed and transferred onto said endless belt or the recording medium held on said endless belt, means for transferring the detection pattern toner images formed on said respective photosensitive bodies onto said endless belt or the recording medium held on said endless belt, means for detecting the detection pattern toner images that have been transferred onto said endless belt or the recording medium held on said endless belt, means for judging the amount of positional deviation in the transfer positions of the detection pattern toner images of the respective colors on the basis of the detection results of said means for detecting the detection pattern toner images, and means for adjusting the rpm of driving parts that drive said photosensitive bodies on the basis of the judgment results of said means for judging the amount of positional deviation in the transfer positions so that the linear velocities of said photosensitive bodies are caused to agree with each other.

11. An image forming device comprising:

a plurality of image carriers which carry visible images on moving surfaces;

driving means which individually drives the respective image carriers;

visible image forming means which forms the visible images on the respective image carriers;

an endless moving body whose surface is caused to move endlessly so as to successively pass through positions facing the respective image carriers;

transfer means which transfers the visible images formed on the surfaces of the respective image carriers onto a recording medium held on the surface of said endless moving body, or which transfers said images onto the surface of said endless moving body, and then transfers said images onto the recording medium;

image detection means which detects the visible images carried on the surface of said endless moving body; and control means which performs speed setting processing of forming specified reference images on the respective image carriers at a specified timing, transferring the reference images onto the surface of said endless moving body, calculating a relative amount of mutual positional deviation in the respective reference images on the basis of a timing at which the respective reference images are detected by said image detection means, and individually setting the driving speeds of the respective image carriers on the basis of said calculation results, wherein said control means is constructed so that the driving speeds of the respective image carriers are individually set within a range in which driving speed differences between the respective image carriers are kept at a specified upper limit value or lower.

12. The image forming device as claimed in claim 11, wherein said upper limit value is a value that reduces differences in an amount of surface movement per unit time between said respective image carriers to values that are smaller than the size of one-half of one pixel.

13. The image forming device as claimed in claim 11, wherein said control means is constructed so that the respective image carriers are driven at the same driving speed when said speed setting processing is performed.

14. The image forming device as claimed in claim 11, wherein respective image forming operations are performed continuously without stopping in a case where, in a continuous image forming operation that continuously forms images on a plurality of recording bodies, an image forming operation for setting the driving speeds of the respective image carriers while forming said reference images is performed between an image forming operation for forming an image on the preceding recording body and an image forming operation for forming an image on the following recording body.

15. The image forming device as claimed in claim 11, wherein said control means is constructed so that the calculated result of said amount of positional deviation or the set value of said driving speed is corrected by the addition of a specified numerical value in said speed setting processing.

16. The image forming device as claimed in claim 11, wherein said control means is constructed so that said upper limit values are respectively varied between a low-speed image forming operation in which images are formed while causing the surfaces of the respective image carriers to move at a relatively low speed, and a high-speed image forming operation in which images are formed while causing the surfaces of the respective image carriers to move at a relatively high speed.

17. The image forming device as claimed in claim 11, wherein the respective image carriers disposed inside a housing of the image forming device are made detachable via openings formed in said housing.

18. The image forming device as claimed in claim 11, wherein said image carriers and charging means that uniformly charge the surfaces of said image carriers are supported by a common supporting body so that a single unit is constructed, and a plurality of said units disposed inside a housing of the image forming device are respectively made detachable via openings formed in said housing.

* * * * *